US009268259B2

(12) United States Patent
Oda

(10) Patent No.: US 9,268,259 B2
(45) Date of Patent: Feb. 23, 2016

(54) DEVELOPER MATERIAL HOLDING APPARATUS, SUPPORTING APPARATUS THAT SUPPORTS THE DEVELOPER MATERIAL HOLDING APPARATUS, AND IMAGE FORMING APPARATUS

(71) Applicant: Oki Data Corporation, Tokyo (JP)

(72) Inventor: Yukiyoshi Oda, Tokyo (JP)

(73) Assignee: OKI DATA CORPORATION, Tokyo (JP)

( * ) Notice: Subject to any disclaimer, the term of this patent is extended or adjusted under 35 U.S.C. 154(b) by 0 days.

(21) Appl. No.: 14/075,127

(22) Filed: Nov. 8, 2013

(65) Prior Publication Data

US 2014/0140735 A1 May 22, 2014

(30) Foreign Application Priority Data

Nov. 20, 2012 (JP) ..... 2012-254350

(51) Int. Cl.
*G03G 15/08* (2006.01)

(52) U.S. Cl.
CPC ..... *G03G 15/0886* (2013.01); *G03G 15/0875* (2013.01); *G03G 2215/0692* (2013.01)

(58) Field of Classification Search
CPC ..... G03G 15/0886; G03G 15/0875; G03G 2215/0692
See application file for complete search history.

(56) References Cited

U.S. PATENT DOCUMENTS

2011/0123232 A1* 5/2011 Takashima et al. ..... 399/258

FOREIGN PATENT DOCUMENTS

JP 2007-093697 A 4/2007
JP 2011-191686 A 9/2011

* cited by examiner

*Primary Examiner* — David Gray
*Assistant Examiner* — Laura Roth
(74) *Attorney, Agent, or Firm* — Rabin & Berdo, P.C.

(57) ABSTRACT

A toner cartridge is supported on a supporting apparatus and includes a chamber that holds toner therein. A shutter has a first engagement portion and is slidably mounted on the toner cartridge and is configured to open and close the opening. A second engagement portion is formed on a body of the toner cartridge. The supporting apparatus includes a supporting surface that supports the toner cartridge thereon. A first limiting element limits movement of the toner cartridge in an insertion direction of the toner cartridge. A stopper limits movement of the shutter in the insertion direction when the toner cartridge is inserted into the supporting apparatus. A second limiting element engages the first engagement portion and the second engagement portion to limit movement of the toner cartridge in a pull-out direction of the toner cartridge and movement of the shutter in the pull-out direction.

18 Claims, 32 Drawing Sheets

DEVELOPER MATERIAL HOLDING APPARATUS, SUPPORTING APPARATUS THAT SUPPORTS THE DEVELOPER MATERIAL HOLDING APPARATUS, AND IMAGE FORMING APPARATUS

BACKGROUND OF THE INVENTION

1. Field of the Invention

The present invention relates to a developer material holding apparatus that holds a developer material therein, a supporting apparatus that receives the developer material holding apparatus therein, and an image forming apparatus that incorporates the supporting apparatus that holds the developer material holding apparatus. The developer material holding apparatus and the supporting apparatus are used in electrophotographic apparatus such as printers, facsimile machines, and copying machines.

2. Description of the Related Art

Some image forming apparatus such as an electrophotographic color recording apparatus incorporate image forming sections aligned in order, each image forming section forming images of a corresponding color. Each image forming section incorporates, for example, a photoconductor on which an electrostatic latent image is formed in accordance with image information and is then developed into a visible image. Each of the image forming sections includes a developing unit and a developer material holding apparatus detachably attached into the image forming apparatus. The image forming section has a toner supplying path located between the developer material holding apparatus and the developing unit. The developing unit includes a supply roller disposed to face a developer roller which is in pressure contact with the photoconductor. The developing unit receives the developer material from the developer material holding apparatus through an opening formed in the developer holding material apparatus.

Japanese Patent Publication No. 2007-93697 discloses one such image recording apparatus. When the developer material holding apparatus is attached to the developing unit, the developer material holding apparatus is first inserted into the developing unit for a locking engagement with the developing unit, and then the lever of the developer material holding apparatus is operated to open the opening formed in the developer material holding apparatus, thereby supplying the developer material into the developing unit. When the developer material holding apparatus is detached from the developing unit, the lever is operated so that the developer material holding apparatus moves out of the locking engagement with the developing unit and then the developing material holding apparatus can be taken out of the developing unit.

The conventional apparatus is configured such that when the developer material holding apparatus is attached to the image recording apparatus, a two-step mounting process is involved: inserting the developer material holding apparatus into the developing unit and then opening the developer material discharging opening of the developer material holding apparatus, and such that when the developer material holding apparatus is detached from the developing unit, another two-step demounting process is involved: closing the developer material discharging opening to unlock the developer material holding apparatus from the developing unit and taking out the developer material holding apparatus from the developing unit. These cumbersome processes may cause the operator to forget to complete the processes.

SUMMARY OF THE INVENTION

An object of the invention is to provide a developer material holding apparatus that requires only simple operations for attaching a developer material holding apparatus into a developing unit and for detaching the developer material holding apparatus from the developing unit.

Another object is to provide a structure which requires a user's simple operation for preventing the developer material holding apparatus from being pulled out inadvertently, thereby allowing the developer material holding apparatus to be pulled out only when the user wants to, and opening and closing the developer material supplying path.

A supporting apparatus is configured to hold a developer material holding apparatus that is mounted on the supporting apparatus. The developer material holding apparatus includes a shutter configured to open and close a developer material discharging opening formed in the developer material holding apparatus. The supporting apparatus includes the following elements. A supporting surface supports the developer material holding apparatus thereon. A first limiting element limits movement of the developer material holding apparatus in an insertion direction in which the developer material holding apparatus is inserted into the supporting apparatus. A stopper limits movement of the shutter in the insertion direction. A second limiting element limits movement of the developer material holding apparatus in a pull-out direction in which the developer material holding apparatus is pulled out of the supporting apparatus, and movement of the shutter in the pull-out direction.

A developer material holding apparatus is detachably attached to a supporting apparatus. The developer material holding apparatus includes the following elements. A chamber (31) holds a developer material therein. The developer material is discharged from the chamber through a discharging opening. A shutter is slidably mounted on a body of the developer material holding apparatus and is configured to open and close the discharging opening. A first engagement portion is formed on the shutter. When the developer material holding apparatus is moved in a pull-out direction in which the developer material holding apparatus is pulled out of the supporting apparatus, the first engagement portion engages a portion of the supporting apparatus so as to limit movement of the shutter in the pull-out direction. A second engagement portion is formed on the body of the developer material holding apparatus. When the developer material holding apparatus is moved in the pull-out direction, the second limiting element engages the portion of the supporting apparatus so as to limit movement of the shutter in the pull-out direction.

An image forming apparatus incorporates a supporting apparatus that detachably supports a developer material holding apparatus thereon. The developer material holding apparatus includes the following elements. A chamber holds a developer material therein. The developer material is discharged from the chamber through a discharging opening formed in the chamber. A shutter is slidably mounted on a body of the developer material holding apparatus, and is configured to open and close the discharging opening. The shutter includes a first engagement portion. A second engagement portion is formed on the body.

The supporting apparatus includes the following elements. A supporting surface supports the developer material holding apparatus thereon. A first limiting element limits movement of the developer material holding apparatus in an insertion direction in which the developer material holding apparatus is inserted into the supporting apparatus. A stopper limits movement of the shutter in the insertion direction when the developer material holding apparatus is inserted into the supporting apparatus. A second limiting element engages the first engagement portion and the second engagement portion to limit movement of the developer material holding apparatus in a pull-out direction in which the developer material holding apparatus is pulled out of the supporting apparatus, and movement of the shutter in the pull-out direction.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limiting the present invention, and wherein.

DETAILED DESCRIPTION OF THE INVENTION

Figure 1:
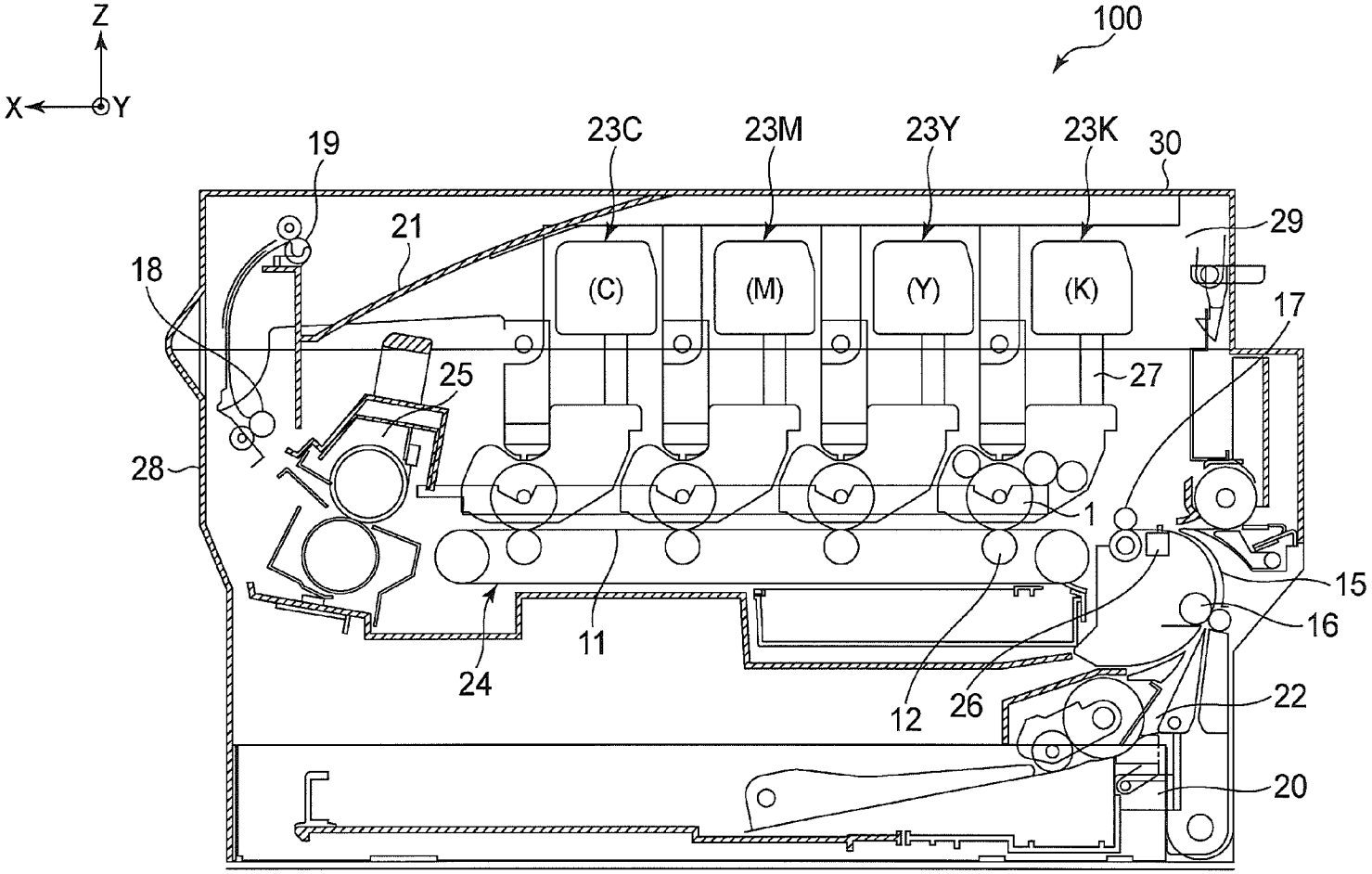
FIG. 1 illustrates an outline of a printer according to a first embodiment.

FIG. 1 illustrates an outline of a printer according to a first embodiment. A printer 100 or an image forming apparatus is an electrophotographic color printer configured to print black (K), yellow (Y), magenta (M), and cyan (C) images. A lower frame 28 houses a generally elongate S-shaped paper transporting path 15 along which paper transporting rollers 16 to 19 are disposed. A paper cassette 20 holds a stack of recording paper as a recording medium, and is disposed at an upstream end of the paper transporting path 15. A stacker 21 holds discharged pages thereon in a stacked manner and is located at a downstream end of the paper transporting path 15.

Further disposed along the paper transporting path 15 are a paper feeding section 22 that feeds the recording paper from the paper cassette 20 on a sheet-by-sheet basis, a paper thickness detector 26 that detects the thickness of the recording paper fed from the paper cassette 20, a belt unit 24 that attracts the recording paper thereto by the Coulomb force and runs in the image forming apparatus while also carrying the recording paper on a transfer belt 11, and a fixing section 25 that fixes the toner images on the recording paper by heat and pressure.

Image forming sections 23K, 23Y, 23M, and 23C are aligned in this order from upstream to downstream in the printer 100, so that the recording paper on a transfer belt 11 is sandwiched between the transfer belt 11 and the respective image forming sections as the transfer belt 11 runs in the printer 100. Each of the image forming sections 23K, 23Y, 23M, and 23C may be substantially identical; for simplicity only the operation of the image forming section 23K for forming black images will be described, it being understood that the other image forming sections 23Y, 23M, and 23C may work in a similar fashion.

An X-axis is a direction in which the recording paper passes through the respective image forming sections 23K, 23Y, 23M, and 23C. A Y-axis is a direction in parallel with the rotational axis of a later described photoconductor 1. A Z-axis is a direction perpendicular to the X-axis and Y-axis. The X-, Y-, and Z-axes indicate directions in which the respective structural elements shown in the figures are oriented. The Z-axis is substantially the same as a gravitational direction.

Figure 2:
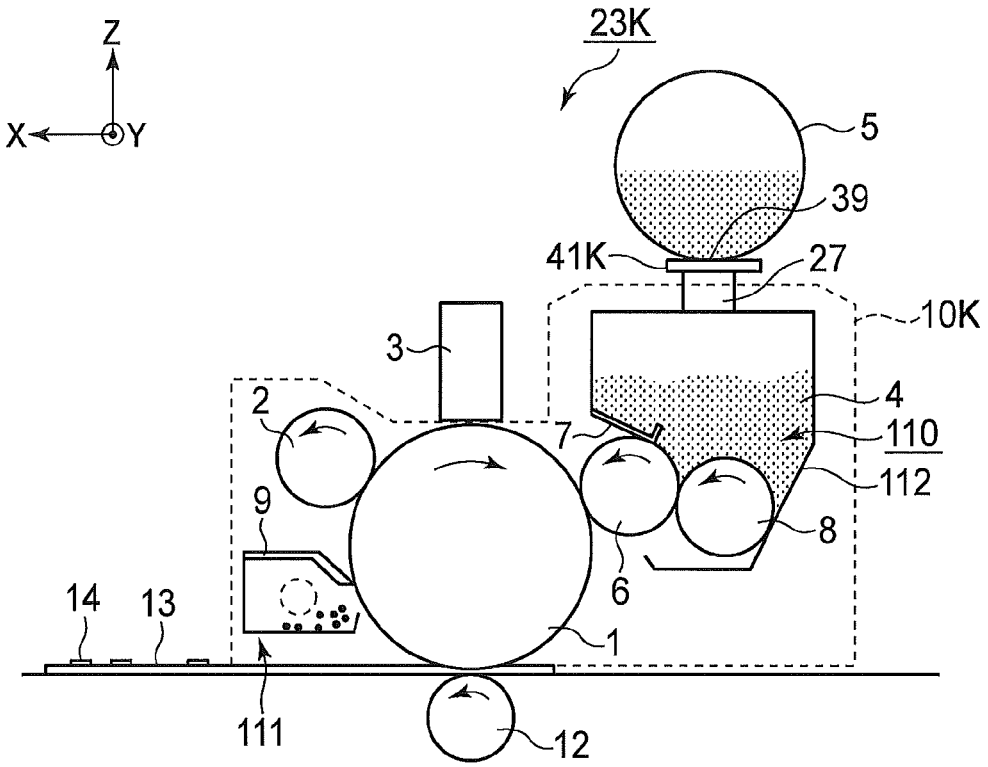
FIG. 2 is a schematic diagram illustrating the outline of a black image forming section, a transfer roller, an exposing device, and printed recording paper.

FIG. 2 is a schematic diagram illustrating the outline of the black image forming section 23K, a transfer roller 12, an exposing device 3, and the printed recording paper 13.

The black image forming section 23K includes a developing unit 10K, a toner cartridge 5K as a developer material holding apparatus, and a toner cartridge supporting unit 41K (FIG. 3) as a supporting apparatus that holds the developer material holding apparatus 5K therein. The toner cartridge is a single piece structure molded from a molding material. The developing unit 41K includes an image developing mechanism 110, charging roller 2, the photoconductor 1 which will be described later.

A photoconductor 1 as an image bearing body is capable of storing charges on a surface thereof, and is supported so that the image bearing body is rotatable in a direction shown by the arrow. The charges on the surface of the photoconductor 1 may be dissipated by irradiating the charged surface with light. Disposed around the photoconductor 1 are a charging roller 2, which rotates in pressure contact with the surface of the photoconductor 1, and the exposing device 3. The charging roller 2 and the exposing device 3 are disposed in this order with respect to the direction of rotation of the photoconductor 1. The charging roller 2 is upstream of the exposing device with respect to the direction of rotation of the photoconductive drum 1. The exposing device 3 includes, for example, a light emitting diode (LED) head that illuminates the charged surface of the photoconductor 1 to form an electrostatic latent image on the surface. The exposing device 3 is located on an upper frame 30 (FIG. 1) of the body of the printer 100.

Further disposed around the photoconductor 1 are a developing mechanism 110 that develops the electrostatic latent image on the photoconductor 1 with the black toner, and a cleaning blade 9 that removes the residual toner that failed to be transferred onto the recording paper 13. The removed toner falls into a waste toner chamber 111 that collects the residual toner therein. The cleaning blade 9 is formed of an elastic material and has its edge in pressure contact with the surface of the photoconductor 1. The rotatable bodies used in the respective devices or sections receive the drive force from drive sources (not shown) through, for example, gear trains.

The developing mechanism 110 includes a toner reservoir that holds the toner 4 supplied through a toner supplying path 27, a developing roller 6, a toner supplying roller 8 that supplies the toner 4 to the developing roller 6, and a developing blade 7 that forms a thin layer of the toner 4 on the developing roller 6. The electrostatic latent image formed on the surface of the photoconductor 1 is developed with the toner 4 into a visible image or a toner image.

The toner cartridge holding unit 41K, which will be described later, holds the toner cartridge 5K thereon so that the toner cartridge 5K may be detachably attached to the toner cartridge supporting unit 41K. The toner cartridge 5K discharges the toner 4 through a toner discharging opening 39 formed in the bottom of the toner cartridge 5K. The toner 4 is supplied through the tone supplying path 27 into the toner reservoir 112. The toner cartridge supporting unit 41K is disposed on the printer 100 side.

The developing roller 6 and toner supplying roller 8 extend parallel to each other and are in pressure contact with each other. The developing roller 6 and toner supplying roller 8 rotate in directions shown by arrows, respectively. The developing blade 7 has a bent corner that is in pressure contact with the developing roller 6. The developing blade 7 extends in parallel with the developing roller 6 so that the developing blade 7 and the developing roller 6 are in contact with each other across the entire length thereof. The rotatable bodies used in the respective devices or sections receive the drive force from drive sources (not shown) through, for example, gear trains.

Referring back to FIG. 1, the transfer rollers 12 are formed of, for example, an electrically conductive rubber material, and face corresponding photoconductors 1 so that the transfer belt 11 to which the recording paper 13 is attracted by the Coulomb force is sandwiched between the photoconductor 1 and the transfer rollers 12. In order that the toner images are transferred onto the recording paper 13, the transfer rollers 12 receive a voltage so that a potential difference is developed across the photoconductor 1 and the transfer rollers 12.

The fixing section 25 includes a heat roller and a back-up roller therein, and fixes the transferred toner 14 on the recording paper 1 (FIG. 2) by heat and pressure. After fixing, the recording paper 13 is discharged by paper transporting rollers 18 and 19 disposed downstream of the fixing section 25, and is then discharged onto the stacker 21.

The outline of the operation of the printer 100 will be described with reference to FIGS. 1 and 2.

For the toner cartridge, the image forming section, developing unit, toner cartridge supporting unit, the numerals alone refer to the same thing as the numerals with letters. Once printing is started, the paper feeding section 22 feeds the recording paper 13 from the paper cassette 20 into the paper transporting path 15 in a downstream direction of the travel of the recording paper 13. The paper thickness detector 26, which is disposed along the paper transporting path 15, detects the thickness of the recording paper 13. Subsequently, the belt unit 24 transports the recording paper 13 through the respective image forming sections 23, so that the toner images of the corresponding colors are transferred onto the recording paper 13 one over the other in registration. Subsequently, the toner images on the recording paper 13 are fixed by the fixing section 25 and the recording paper is then discharged onto the stacker 21.

In each image forming section 23, the toner 4 received from the toner cartridge 5 is supplied to the developing roller 6 by the toner supplying roller 8. The toner 4 on the developing roller 6 is formed into a thin layer by the developing blade 7. The toner 4 on the developing roller 6 is then supplied to the electrostatic latent image formed on the photoconductor 1, thereby developing the electrostatic latent image with the toner 4 into a toner image. The toner image is then transferred by the Coulomb force onto the recording paper 13. The residual toner, which failed to be transferred onto the recording paper, is removed from the photoconductor 1 by the cleaning blade 19 and falls into the waste toner chamber 111.

Next, the toner cartridge 5 according to the first embodiment will be described in terms of the mechanism for inserting the toner cartridge 5 into and pulling the toner cartridge 5 out of the printer 100.

Figure 3:
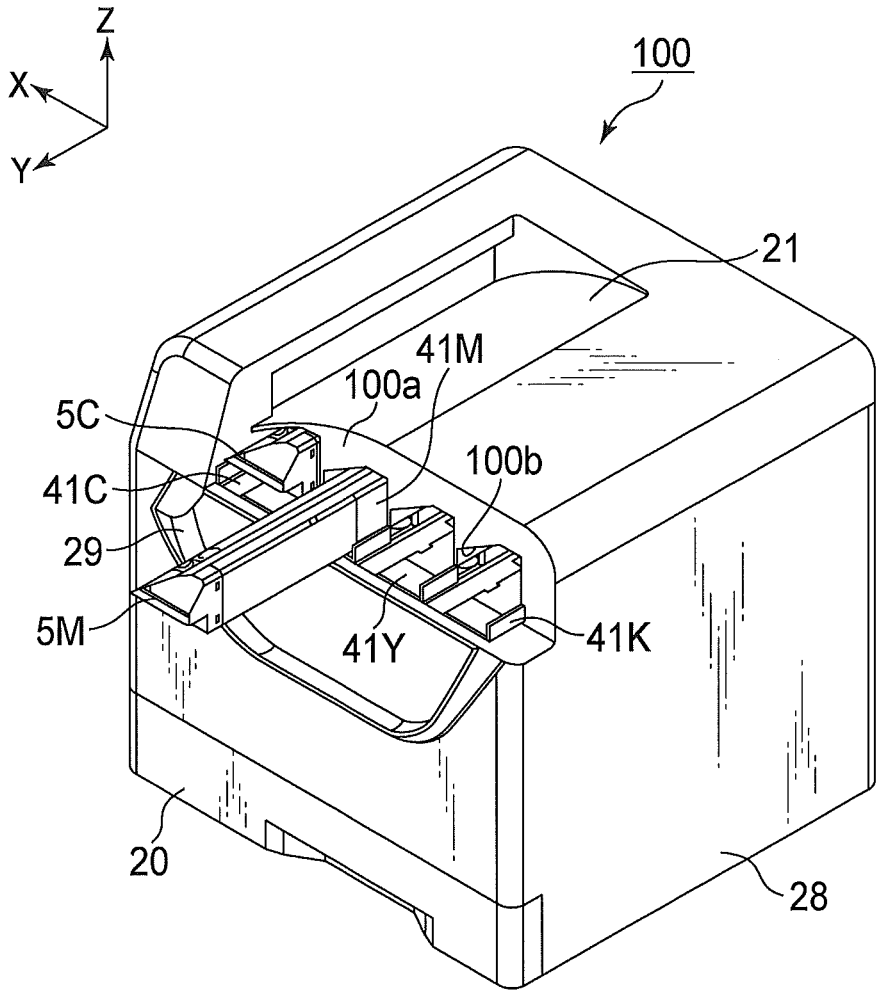
FIG. 3 is a perspective view illustrating a printer when a front cover has been opened.
Figure 4:
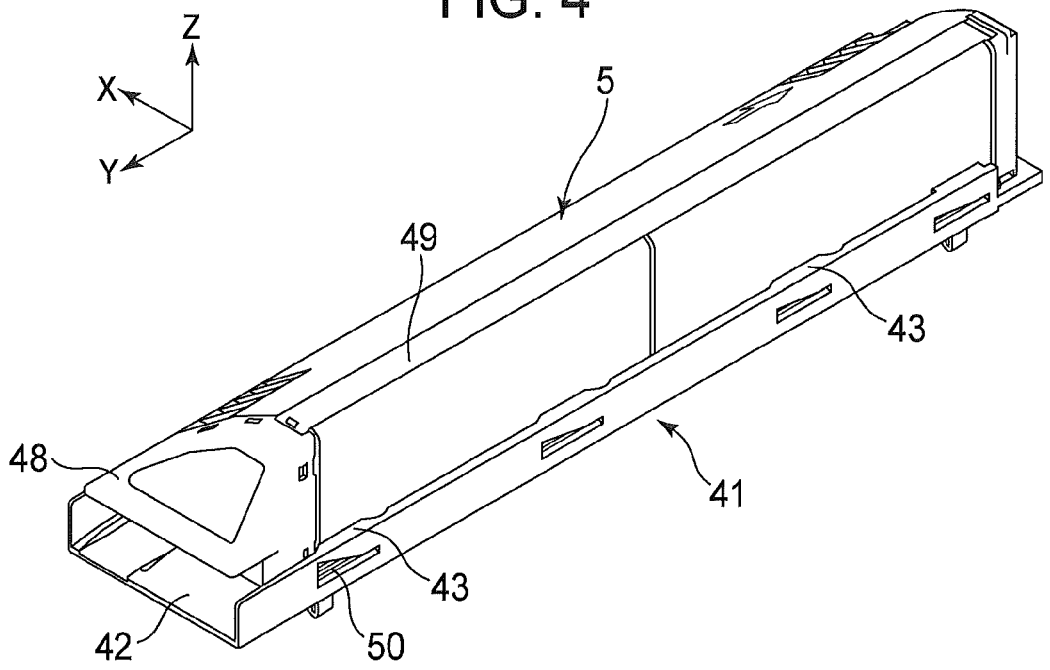
FIGS. 4 and 5 are perspective views illustrating a toner cartridge, as seen in different directions, held by a toner cartridge supporting unit.
Figure 5:
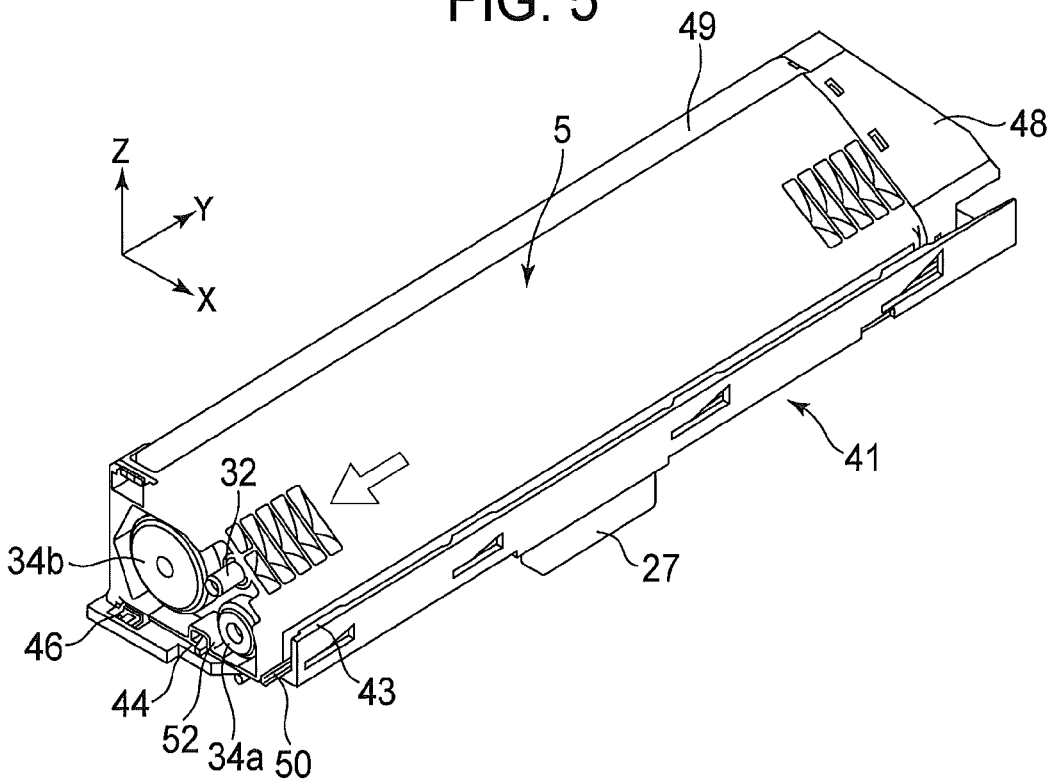
Figure 6:
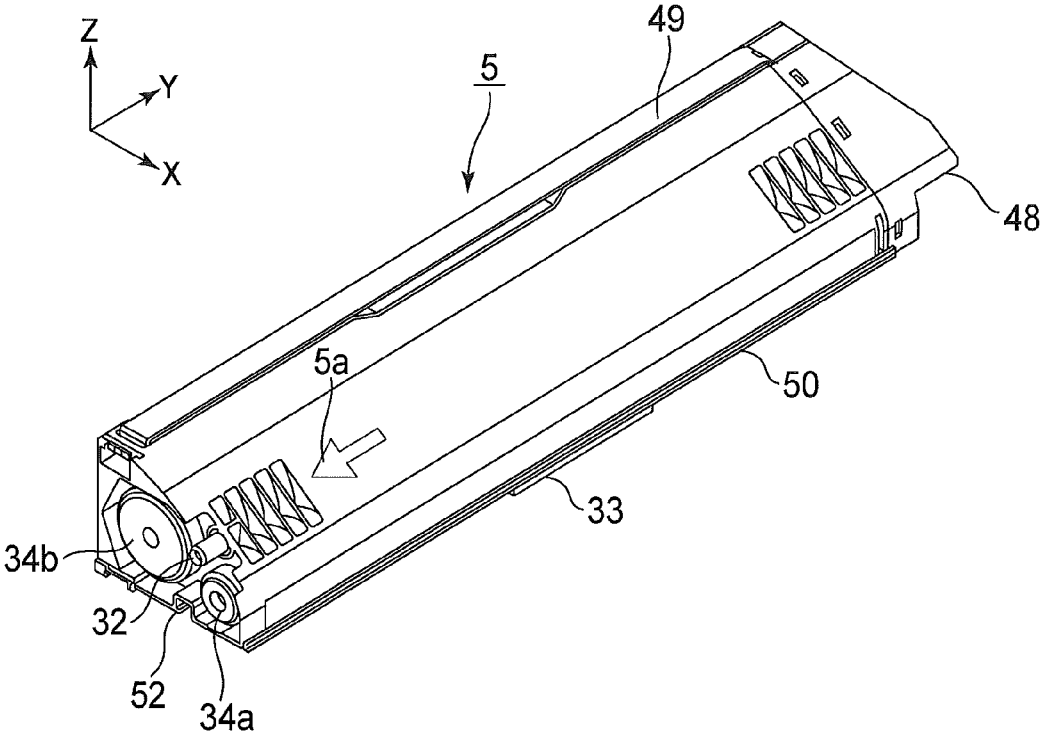
FIG. 6 is a perspective view of the toner cartridge as seen obliquely from above.
Figure 7:
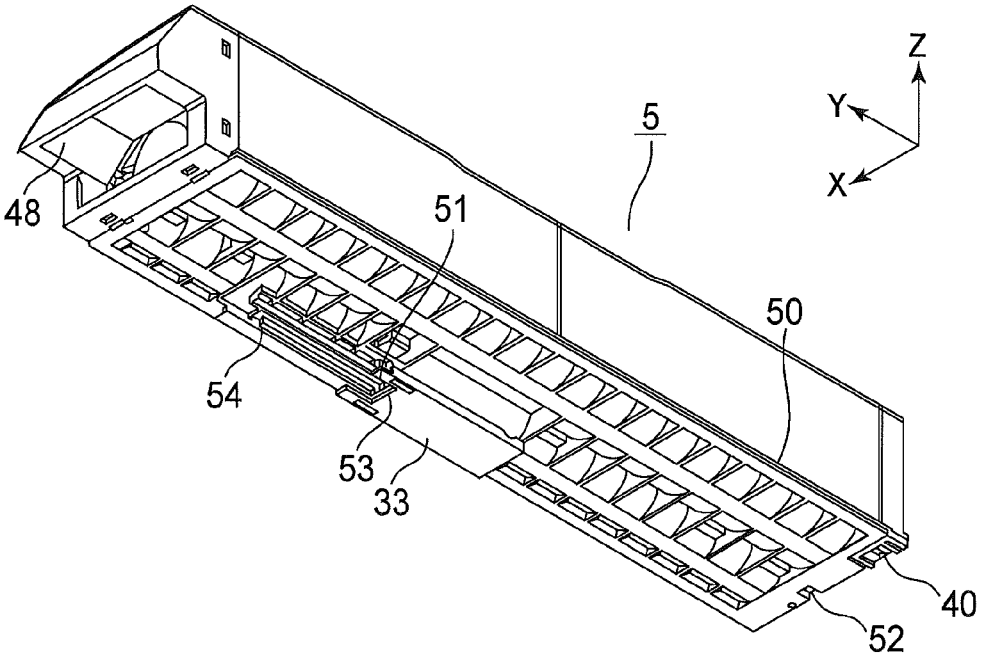
FIG. 7 is a perspective view of the toner cartridge as seen obliquely from under.
Figure 8:
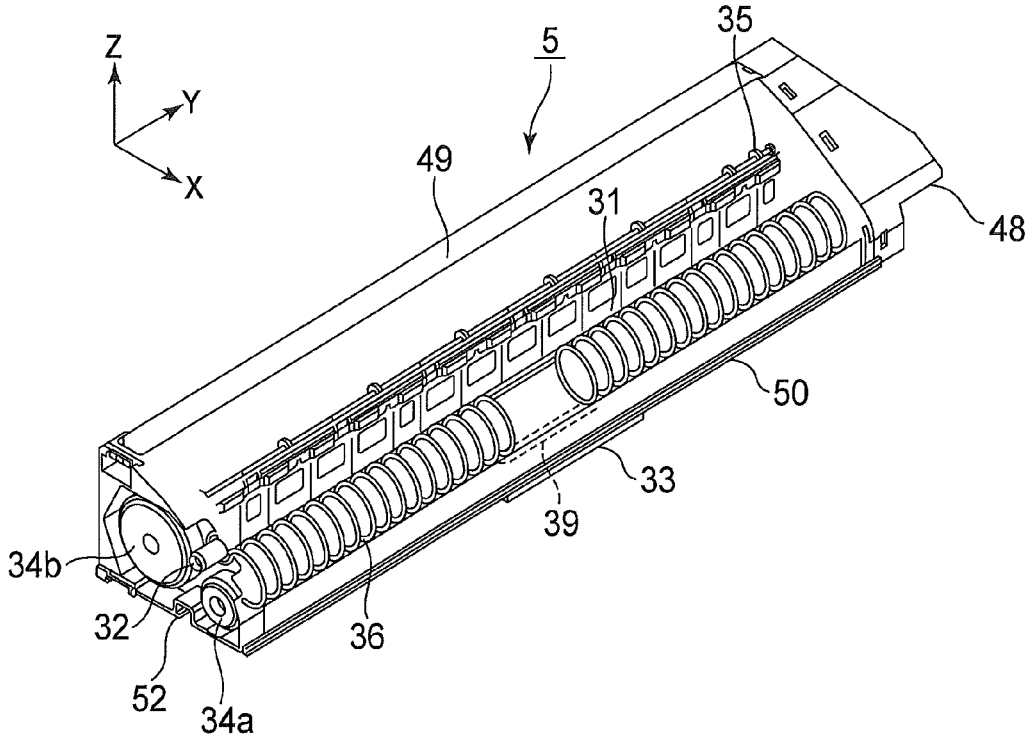
FIG. 8 is a perspective view of the toner cartridge with the cover cutaway partially.
Figure 9:
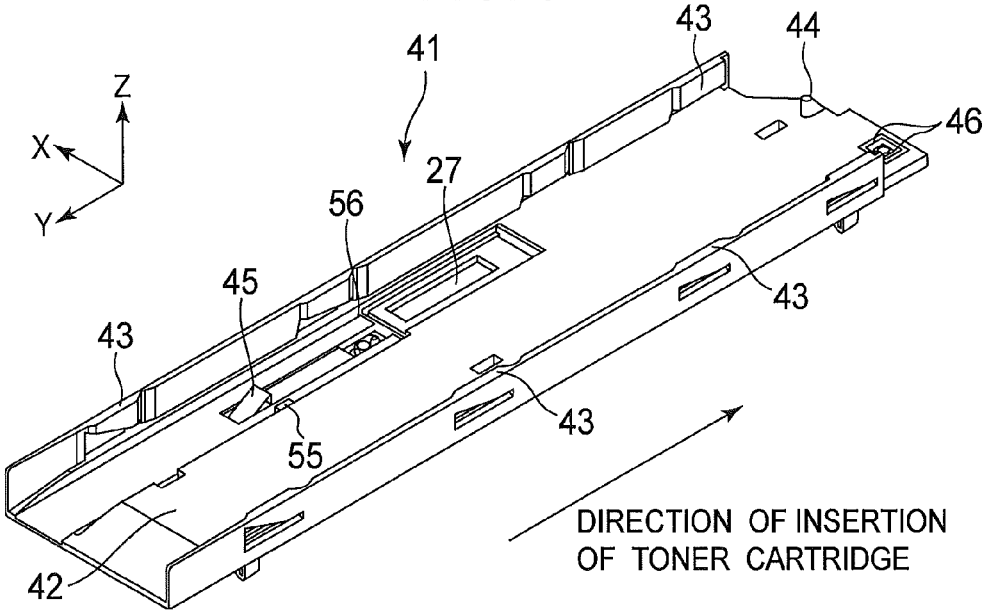
FIGS. 9 and 10 are perspective views of a toner cartridge supporting unit as seen from different directions.
Figure 10:
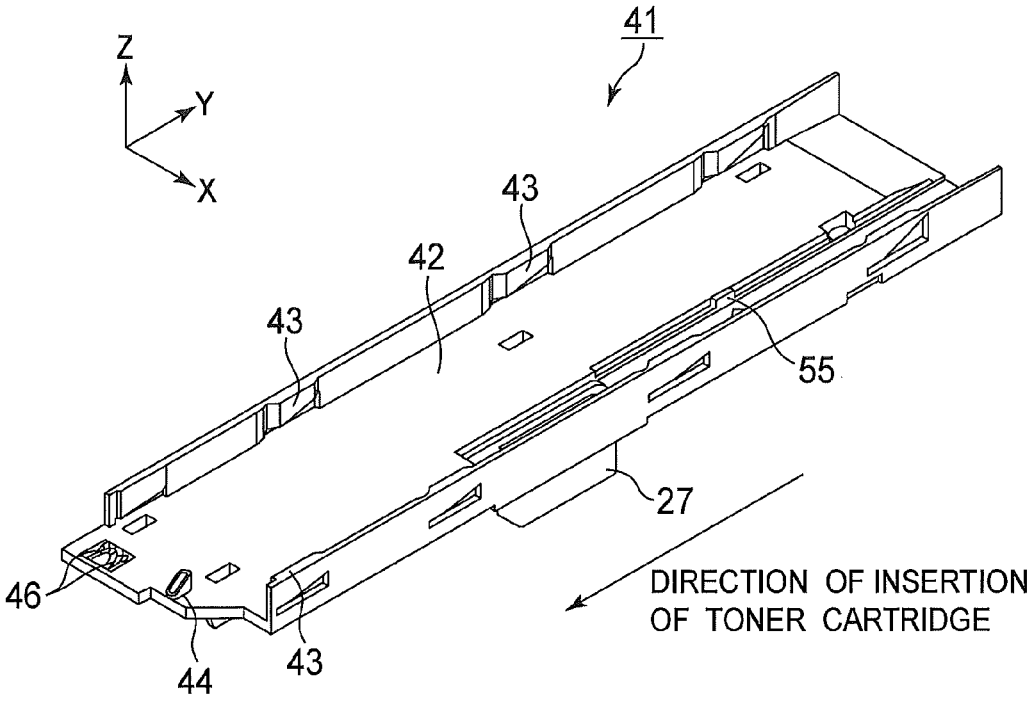

FIG. 3 is a perspective view illustrating the printer 100 when the front cover 29 has been opened. FIGS. 4 and 5 are perspective views as seen indifferent directions, illustrating the toner cartridge 5 held by the toner cartridge supporting unit 41. FIG. 6 is a perspective view of the toner cartridge 5 as seen obliquely from above. FIG. 7 is a perspective view of the toner cartridge 5 as seen obliquely from under. FIG. 8 is a perspective view of the toner cartridge 5 with the cover cutaway partially, illustrating the inside of the toner cartridge 5. FIGS. 9 and 10 are perspective views of the toner cartridge supporting unit 41 as seen from different directions.

Referring to FIGS. 1 to 3, each of the toner cartridge supporting units 41K, 41Y, 41M, and 41C is disposed between a corresponding one of the toner cartridges 5K, 5Y, 5M, and 5C and a corresponding one of the developing units 10K, 10Y, 10M, and 10C, and is secured to the body of the printer 100. The front cover 29 is supported on the front surface of the printer 100 and is pivotal about an axis substantially parallel to the X-axis. The front cover 29 opens and closes a cartridge receiving section 100*a* into which the toner cartridge 5 is inserted into or pulled out of the printer 100. The cartridge receiving section 100*a* includes openings 100*b* that project outwardly of the printer 100 and receive the toner cartridges 5 therein.

Referring to FIG. 3, the toner cartridge supporting unit 41C holds the toner cartridge 5C that has been inserted completely, the toner cartridge supporting unit 41M holds the toner cartridge 5M partially inserted into the opening 100*b*, and the toner cartridges 5Y and 5K have been pulled out of the openings 100*b*. FIGS. 4 and 5 illustrate the toner cartridge 5 that has been attached to the corresponding toner cartridge supporting unit 41 disposed at a predetermined location in the printer 100. The toner cartridge 5 and corresponding toner cartridge supporting unit 41 extend in a direction substantially parallel to the Y-axis in the printer 100.

Figure 16A:
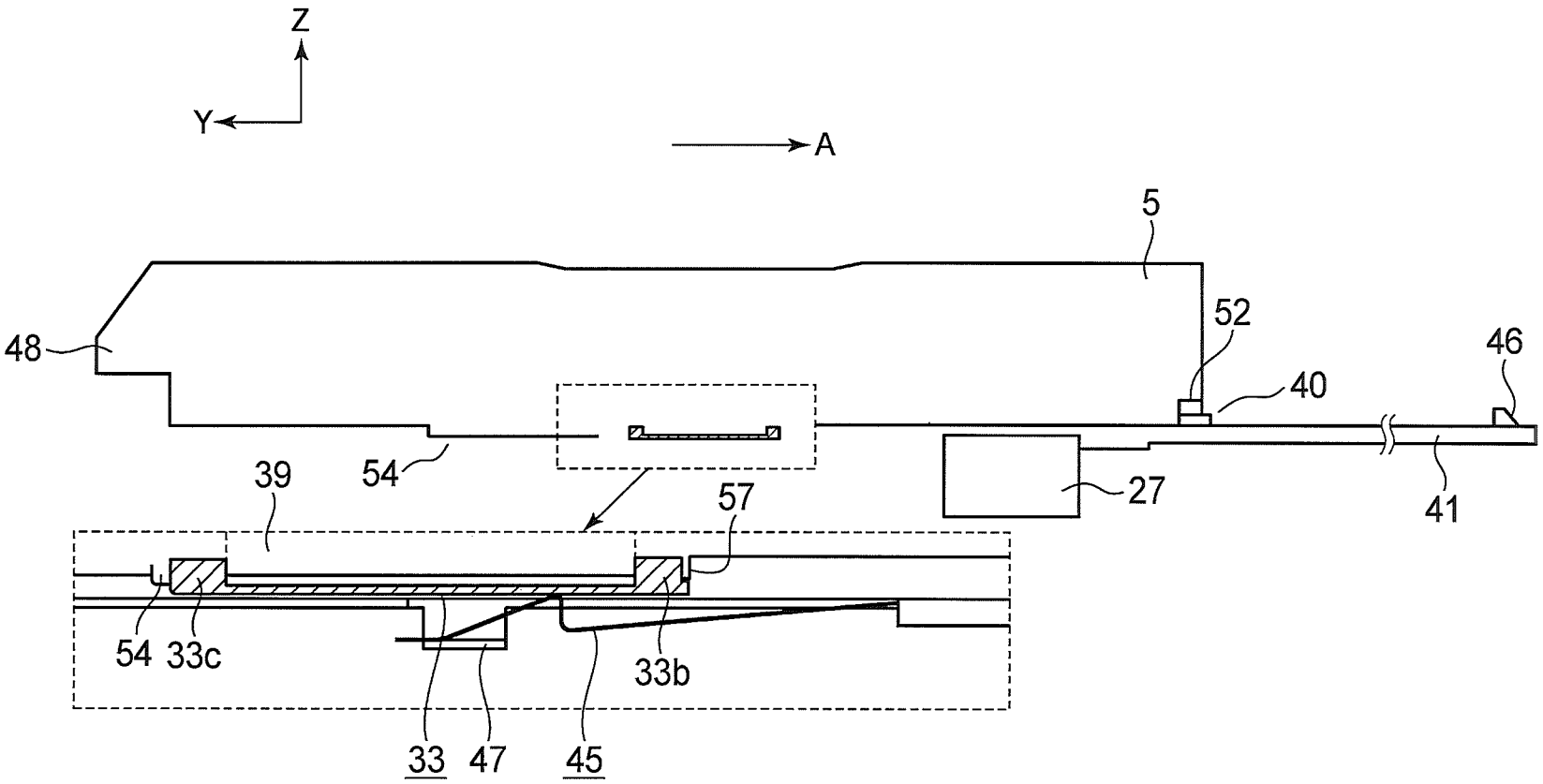
FIGS. 16A, 16B, 17A, and 17B illustrate the operation of a second latch and involved portions from when the tone cartridge begins to be inserted into the toner cartridge supporting unit till the toner cartridge has been inserted completely.

Referring to FIGS. 6-8, the toner cartridge 5 is formed of the following structural elements. A toner chamber 31 (FIG. 8) as the developer material holding section holds the toner 4 therein. The toner 4 is discharged through the toner discharging opening 39 (FIG. 8) formed in a lower portion of the developer material holding section 31. A shutter 33 (FIG. 8) is mounted on the toner cartridge 5 so that the shutter 33 is slidable in a longitudinal direction of the toner cartridge 5 to open and close the toner discharging opening 39 (FIG. 8). The shutter 33 has opposing end portions, i.e., a leading end portion 33*b* and a trailing end portion or a first latch engagement portion (FIG. 16A). A positioning post 32 (FIG. 8) fits into an opening concentrically formed in a drive gear 37 (FIG. 11) on the printer 100 side to position the toner cartridge 5 relative to the drive gear 37. A limiting groove 52 (FIG. 8) serves to hold the toner cartridge 5 in place against the rotational drive force when the drive force is transmitted to the toner cartridge 5 through the drive gear 37. An outer rib 50 (FIGS. 6 and 7) guides the toner cartridge 5 to slide relative to the toner cartridge supporting unit 41. Gears 34*a* and 34*b* (FIG. 6) are brought into a meshing engagement with the drive gear 37 and are driven by the drive gear 37. A spiral 36 (FIG. 8) rotates with the gear 34*a* to transport the toner 4 to the toner discharging opening 39. An agitator 35 (FIG. 8) rotates with the gear 34*b* to agitate the toner 4. A toner cartridge identifier 40 (FIG. 7) determines whether the toner cartridge 5 is a used one or a new, unused one. A first latch 51 (FIG. 7) or fourth limiting element limits opening and closing of the shutter 33. A stopper 57 extends in a direction shown by arrow A (FIGS. 16A and 16B) and abuts the leading end portion 33*b* of the shutter 33 when the shutter 33 is closed. A handle 49 is gripped by the user when the user handles or carries the cartridge 5. A handhold 48 is used when the user pulls the toner cartridge 5 out of the printer 100.

The toner discharging opening 39 is located at a substantially longitudinal mid-point of the toner cartridge 5. The toner cartridge identifier 40 incorporates a non-volatile memory therein. A white arrow 5*a* (FIGS. 5 and 6) marked on the toner cartridge 5 shows the direction in which the toner cartridge 5 should be inserted into the toner cartridge supporting unit 41.

As is clear from FIGS. 9 and 10, the toner cartridge supporting unit 41 includes the following structural elements. A supporting surface 42 holds the toner cartridge 5 thereon. Guides 43 guide the toner cartridge 5 when the outer rib 50 of the toner cartridge 5 slides on the guides 43. When the toner cartridge 5 is inserted into the toner cartridge supporting unit 41, a positioning element 44 as a first limiting element engages the limiting groove 52 formed in the toner cartridge 5, thereby preventing the toner cartridge from rotating as well as limiting the insertion of the toner cartridge 5 into the toner cartridge supporting unit 41. When the toner cartridge 5 is pulled out of the toner cartridge supporting unit 41, a second latch 45 as a second limiting element causes the shutter 33 to close. A displacement limiting element 47 (FIG. 16) as a third limiting element limits the displacement of the second latch 45. When the user pushes the toner cartridge 5 into the toner cartridge supporting unit 41, a latch releasing post 55 (FIG. 9) formed on the toner cartridge supporting unit 41 pushes up the first latch 51, causing the first latch 51 to resiliently deform. When the toner cartridge 5 is inserted further into the toner cartridge supporting unit 41, a shutter movement limiting element 56 abuts the longitudinal end portion 33*b* of the shutter 33 to limit the movement of the shutter 33 in the insertion direction of the toner cartridge 5. An electrical contact 46 contacts the toner cartridge identifier 40, through which communication may be made between the toner cartridge identifier 40 and the printer 100. The toner supplying path 27 directs the toner 4 when the toner 4 is discharged into the toner reservoir 112.

As shown in FIG. 7, the shutter 33 of the toner cartridge 5 includes the first latch engagement portion 33*c* (FIG. 17) as a first engagement portion, which interferes with the second latch 45 (FIG. 9) when the user pulls the toner cartridge 5 out of the printer 100. The toner cartridge 5 also includes a second latch engagement portion 54 (FIG. 17) as a second engagement portion located at an outer bottom of the toner cartridge 5. When the toner cartridge 5 has been attached to the printer 100, the second latch engagement portion 54 interferes with the second latch 45. The second latch engagement portion 54 is a portion of the toner cartridge molded from a molding material. The second latch engagement portion 54 is disposed on the outer bottom of the toner cartridge 5 and extends across a region in which the first latch engagement portion 33*c* or trailing end portion moves.

Figure 20A:
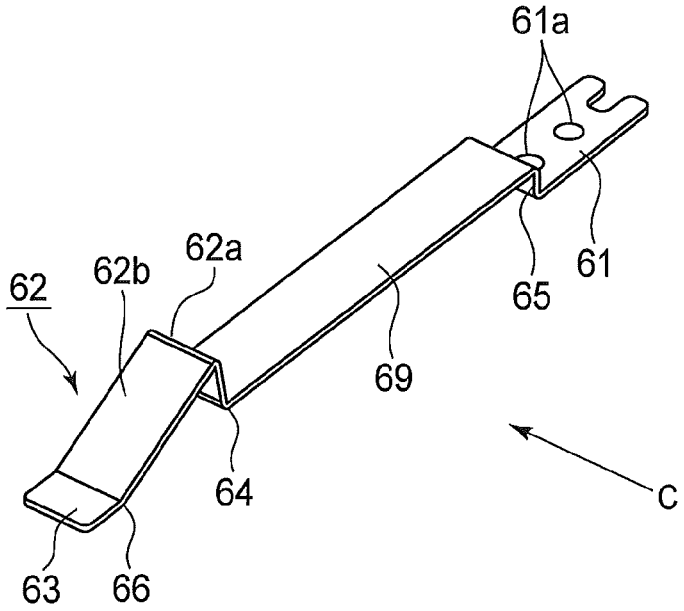
FIG. 20A is a perspective view of the second latch.
Figure 20B:
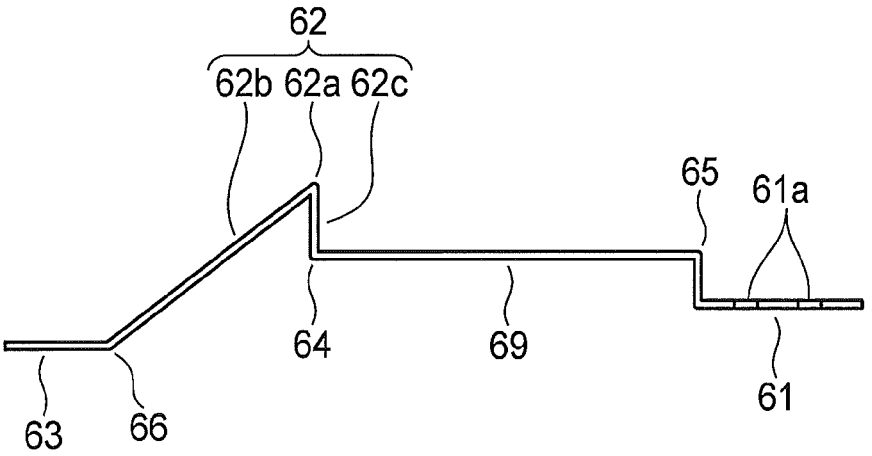
FIG. 20B is a side view of the second latch as seen in a direction shown by arrow C shown in FIG. 20A.

FIG. 20A is a perspective view of the second latch 45. FIG. 20B is a side view of the second latch as seen in a direction shown by arrow C shown in FIG. 20A. The second latch 45 takes the form of a thin metal plate of, for example, SUS having a thickness of 0.3 mm in a single piece construction. The second latch 45 includes a securing portion 61 with screw holes 61*a* formed therein, a resiliently deformable portion 69, a projection 62, a free end 63, a first kinked portion 64 at which the resiliently deformable portion 69 and the substantially vertical abutment wall 62*c* projection 62 meet at their ends, a second kinked portion 65 at which the securing portion 61 and the resiliently deformable portion 69 meet at their ends, a third kinked portion 66 at which the inclined portion 62*b* and the free end portion 63 meet at their ends, and a fourth kinked portion 62*a* at which the inclined portion 62*b* and the abutment wall 62*c* meet at their ends. The projection 62 includes an inclined portion 62*b* and the abutment wall 62*c* substantially perpendicular to the resiliently deformable portion 69. The free end portion 63 is contiguous to the inclined portion 62*b* and extends in a direction substantially parallel to the resiliently deformable portion 69.

As shown in FIG. 9, the second latch 45 has the free end portion 63 extending in a direction parallel to the Y-axis toward the opening 100*b*, and the securing portion 61 adjacent to the toner supplying path 27. The securing portion 61 is screwed to the toner cartridge supporting unit 41 by means of screws inserted through the screw holes 61*a*. A displacement limiting element 47 (FIG. 16) limits displacement of the free end portion 63.

A description will be given of the operation in which the toner cartridge 5 is inserted into the printer 100.

Figure 11:
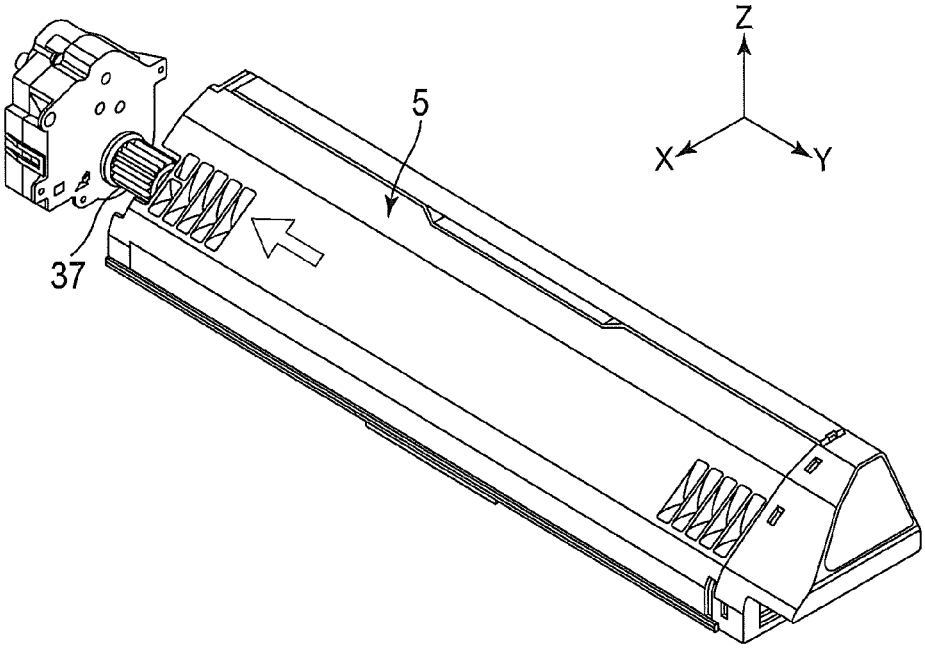
FIG. 11 is a perspective view illustrating the toner cartridge and a drive gear as seen in an oblique direction from above.
Figure 12:
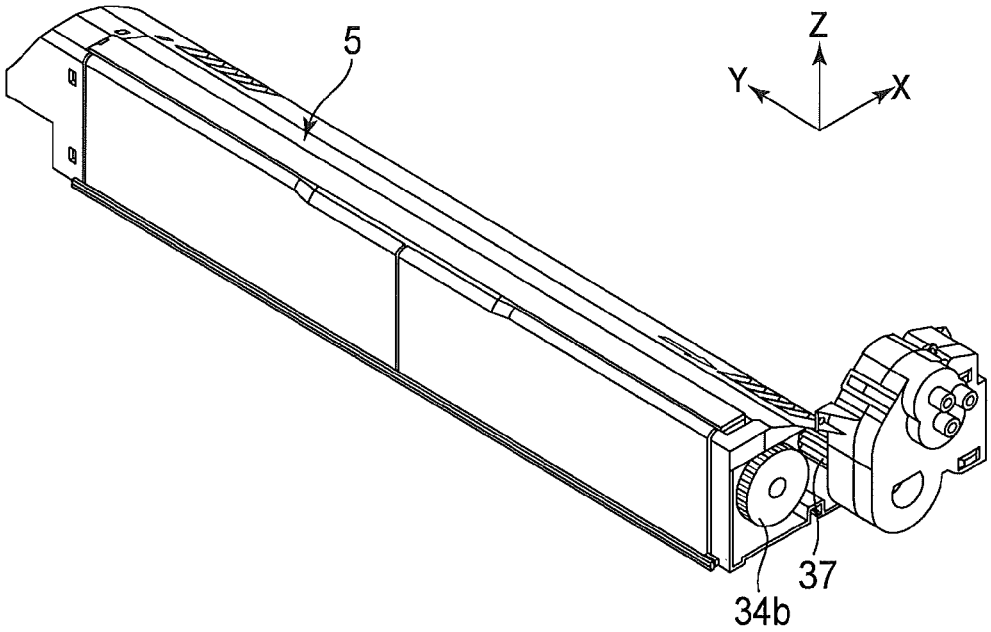
FIG. 12 is a perspective view illustrating the toner cartridge and the drive gear as seen in another oblique direction from above.

FIGS. 11 and 12 are perspective views as seen in different directions, illustrating the gear 34*a* (not shown) and 34*b* that are disposed in the toner cartridge 5 and are in a meshing engagement with the drive gear 37 disposed in the printer 100.

Figure 13:
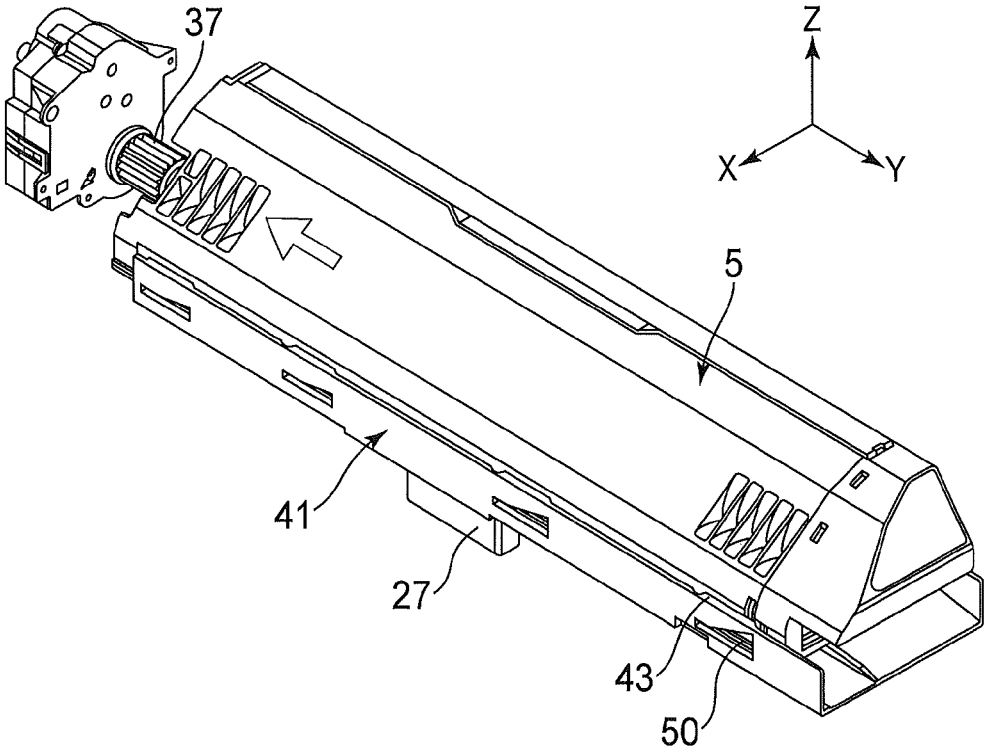
FIGS. 13 and 14 are perspective views, as seen indifferent directions, illustrating the gears in mesh with the drive gear shortly after the toner cartridge has been attached to the toner cartridge supporting unit.
Figure 14:
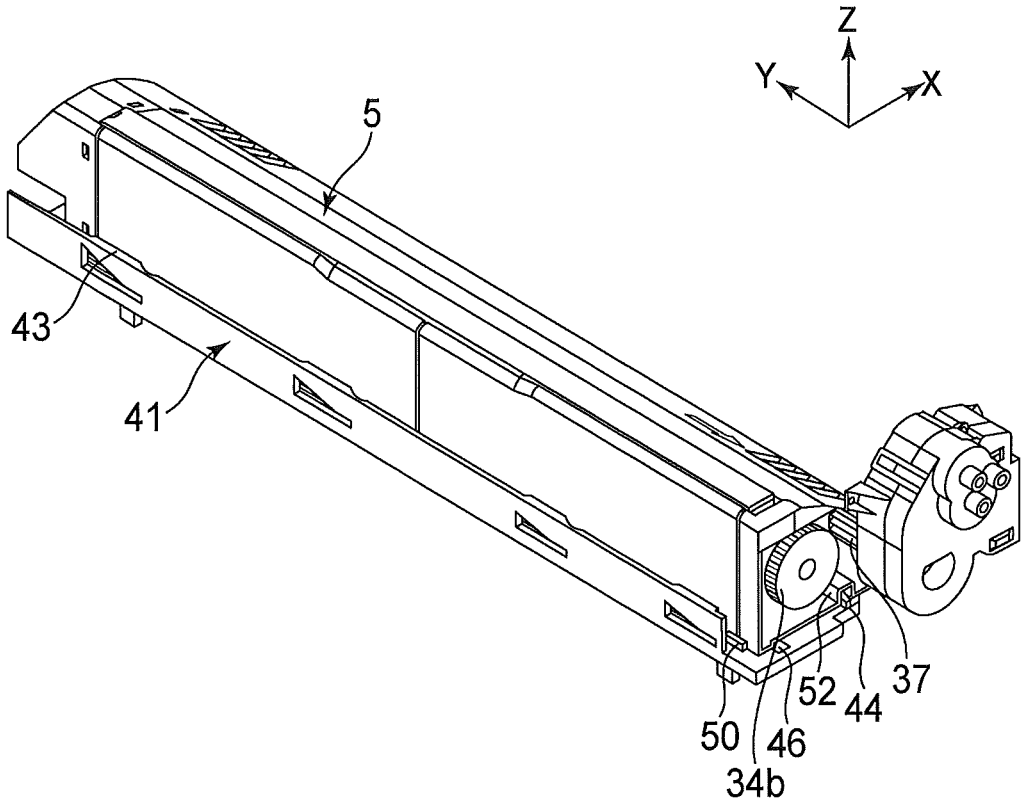
Figure 15A:
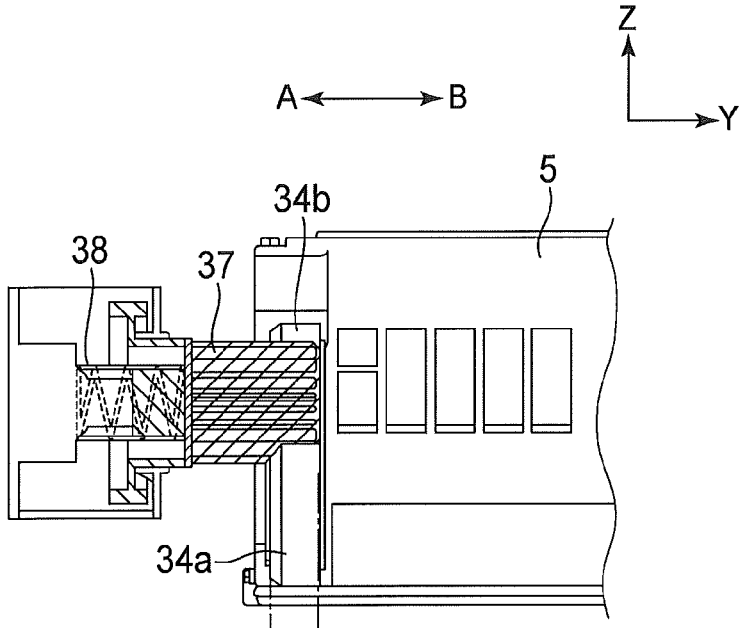
FIG. 15A illustrates the gears after the gears have moved into a meshing engagement with one another.
Figure 15B:
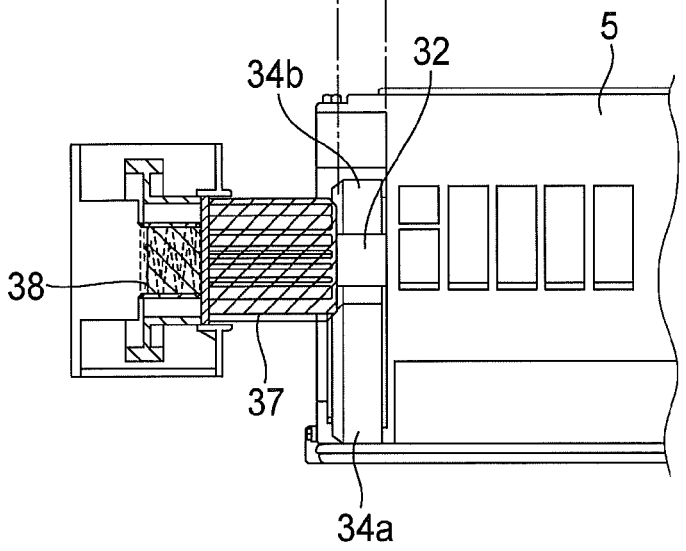
FIG. 15B illustrates the gears before the gears have moved into a meshing engagement with one another.

FIGS. 13 and 14 are perspective views, as seen in different directions, illustrating the gears 34*a* (not shown) and 34*b* in mesh with the drive gear 37 shortly after the toner cartridge 5 has been attached to the toner cartridge supporting unit 41. FIGS. 15A and 15B illustrate the positional relationship among the gears 37, 34*a*, and 34*b*. FIG. 15A illustrates the gears 37, 34*a*, and 34*b* after the gears 37, 34*a*, and 34*b* have moved into a meshing engagement with one another. FIG. 15B illustrates the gears 37, 34*a*, and 34*b* before the gears 37, 34*a*, and 34*b* have moved into a meshing engagement with one another.

Figure 16B:
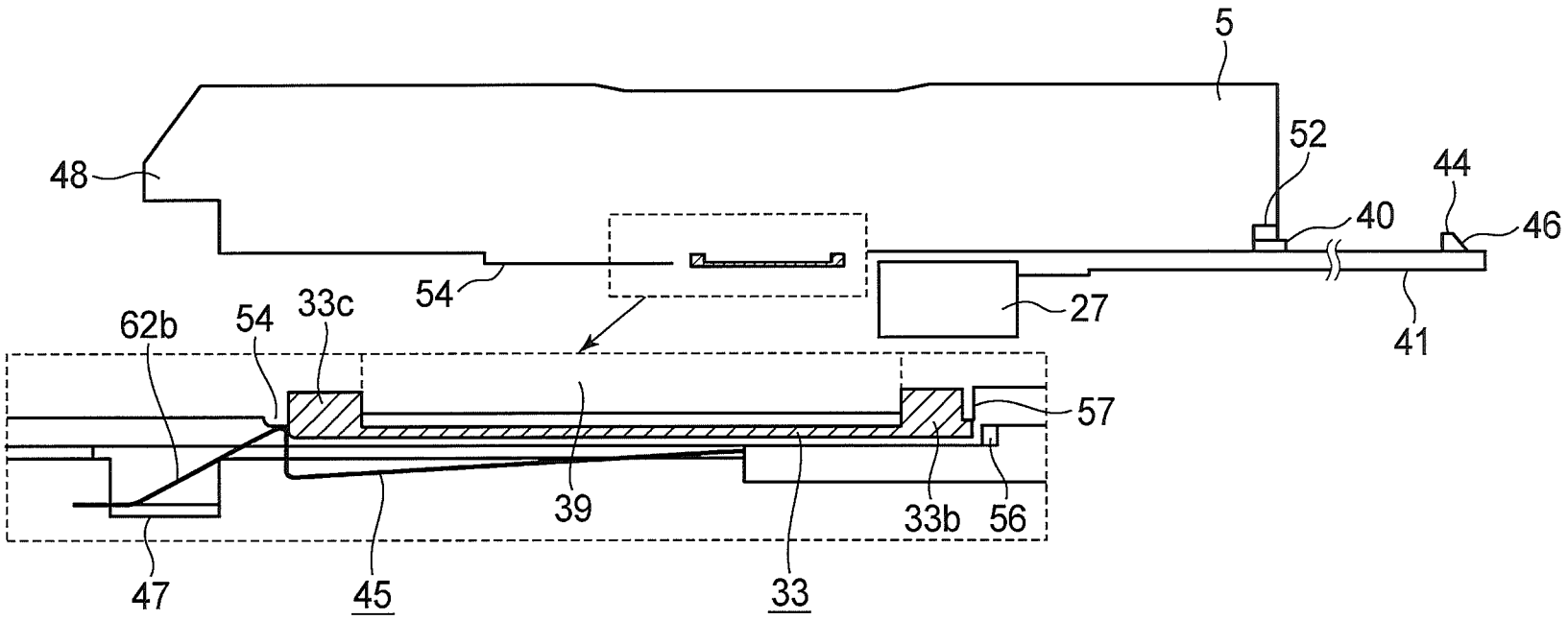
Figure 17A:
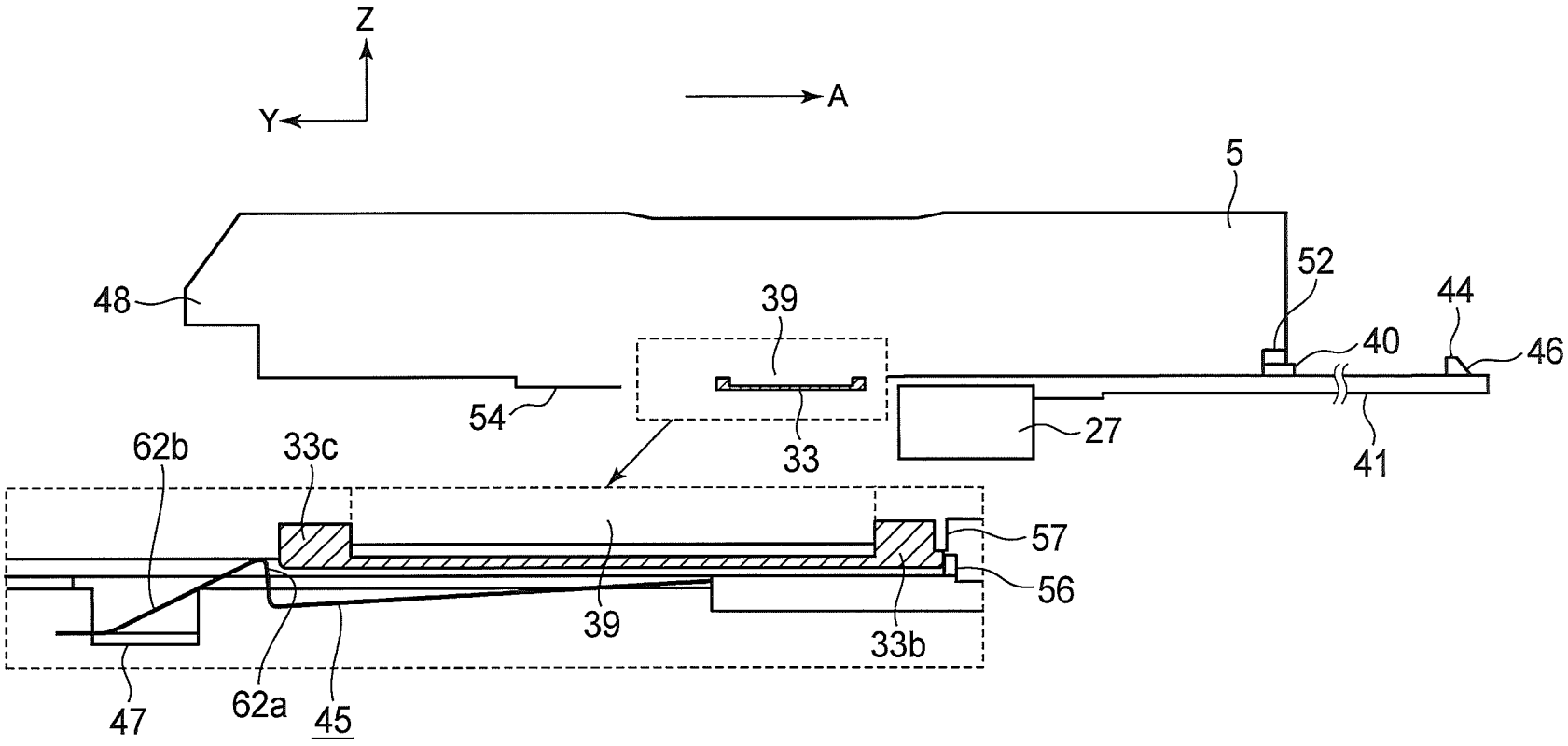
Figure 17B:
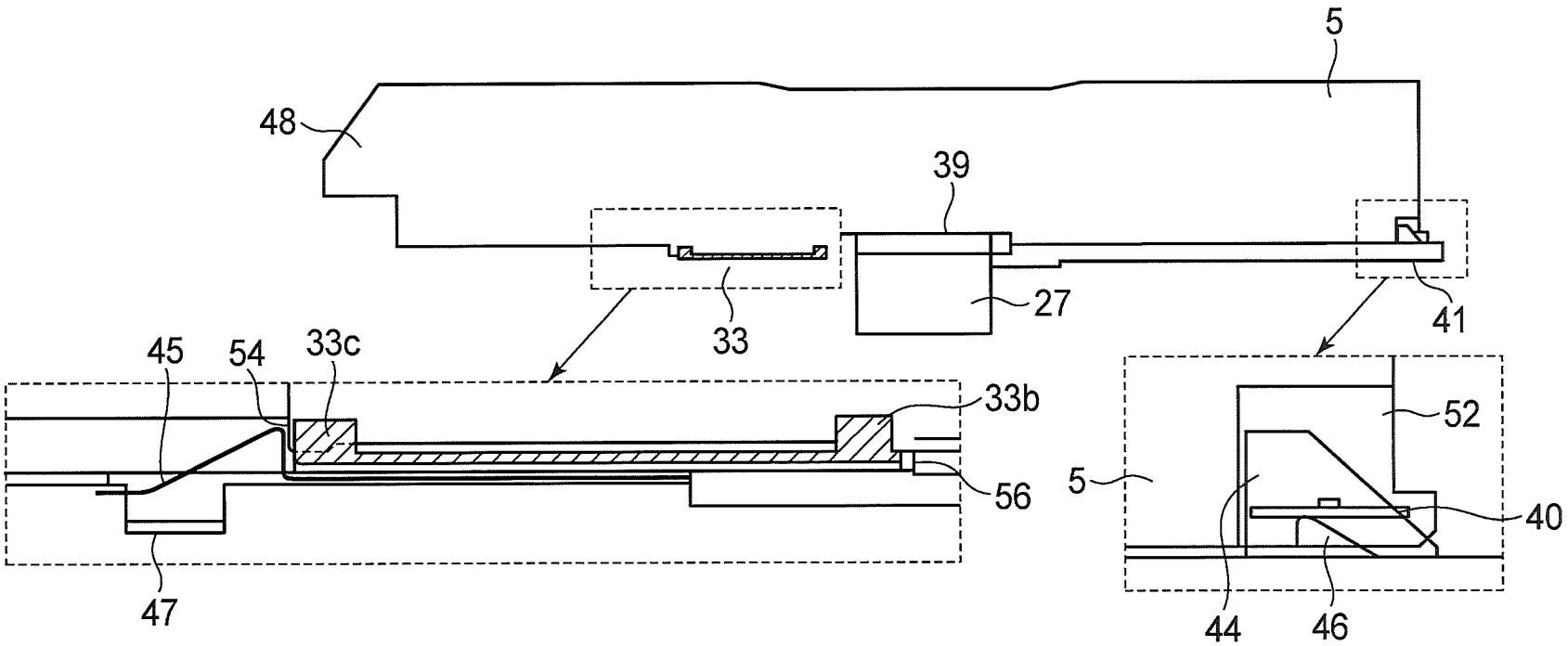
Figure 18A:
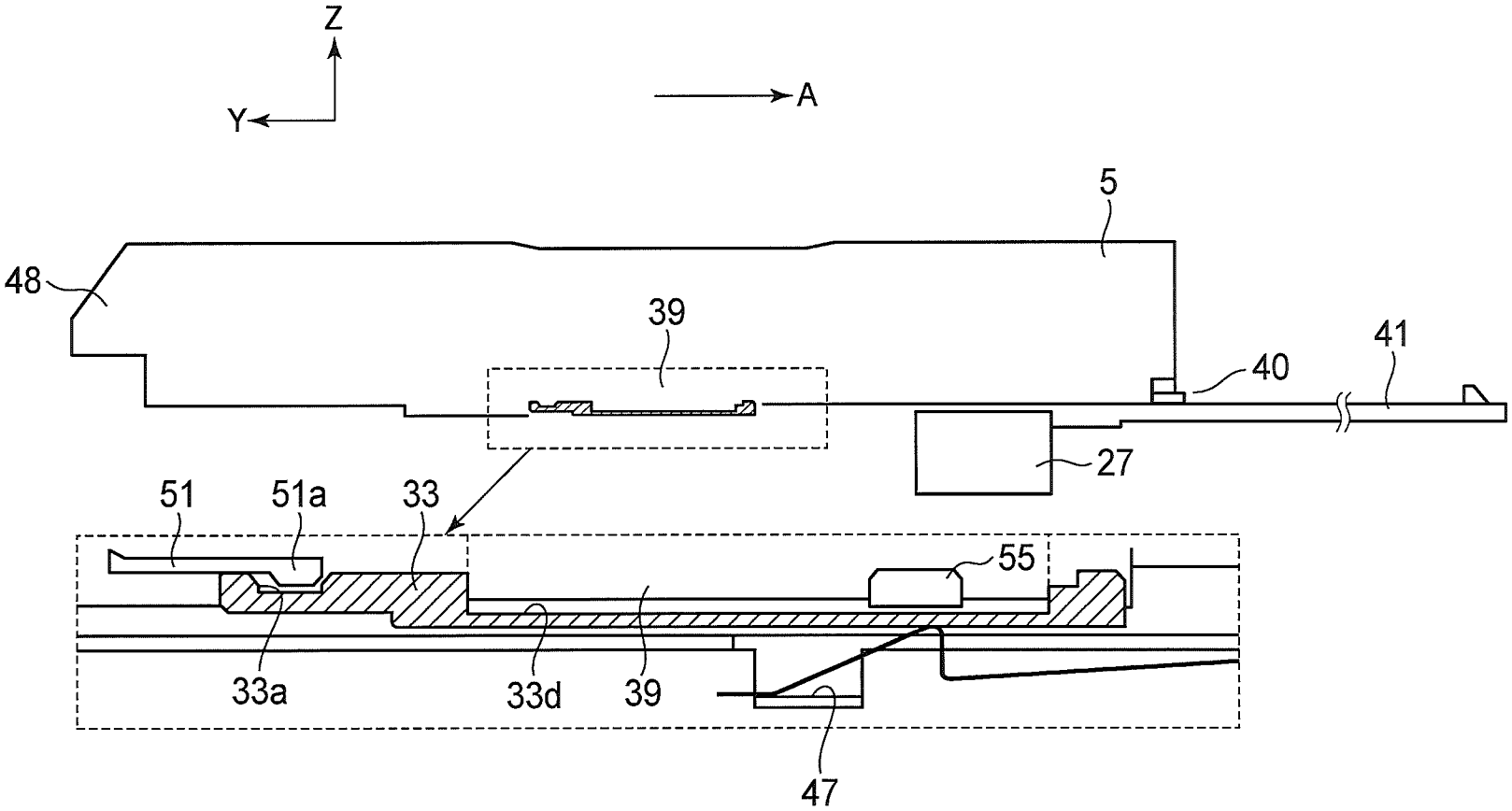
FIGS. 18A-18D, and 19A-19D illustrate the operation of the latch releasing post and involved portions.
Figure 18B:
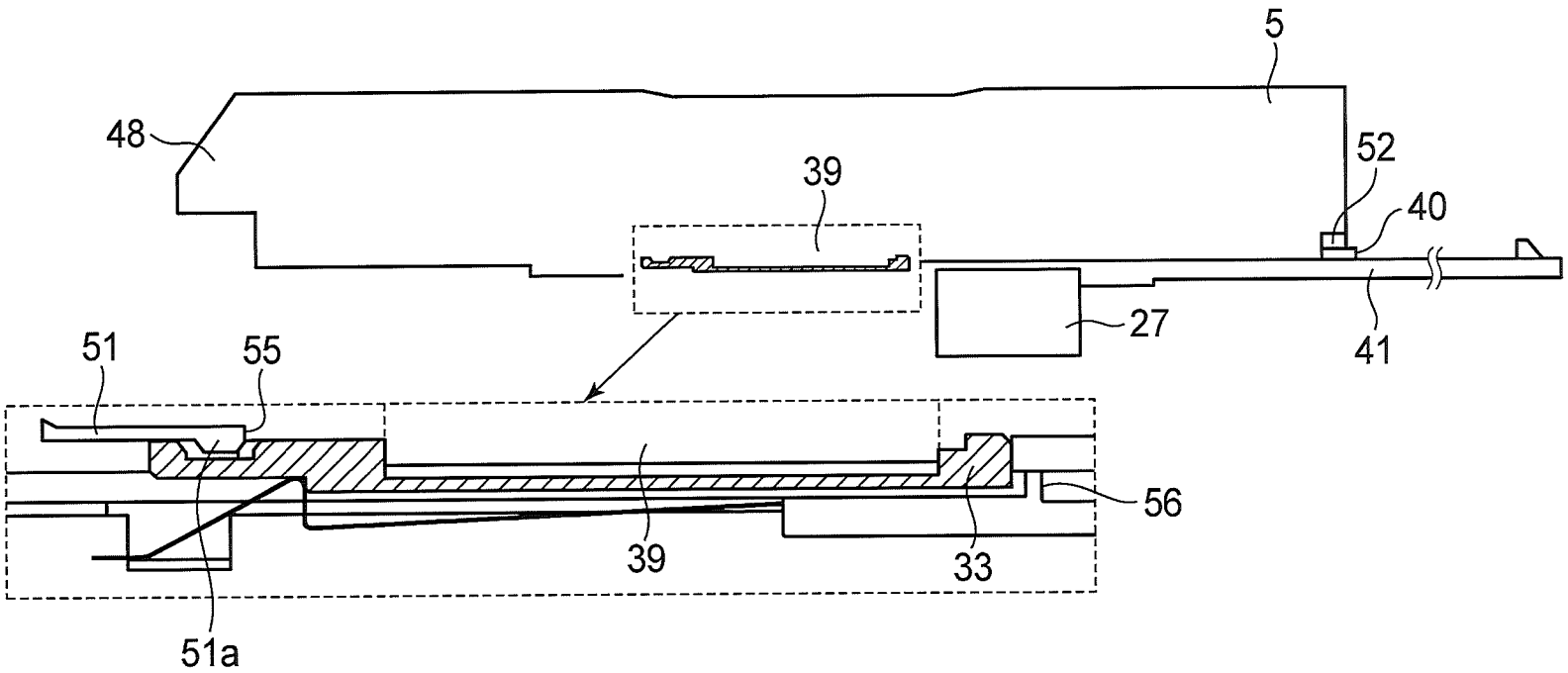
Figure 18C:
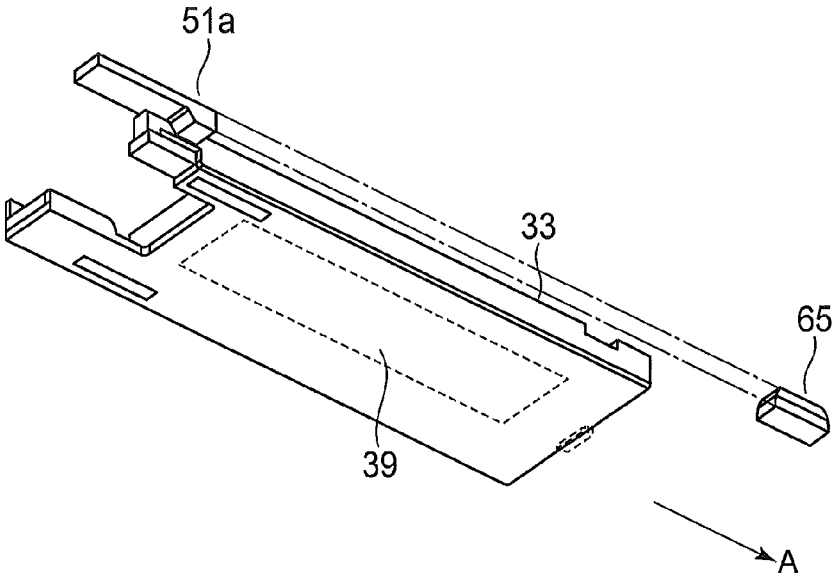
Figure 18D:
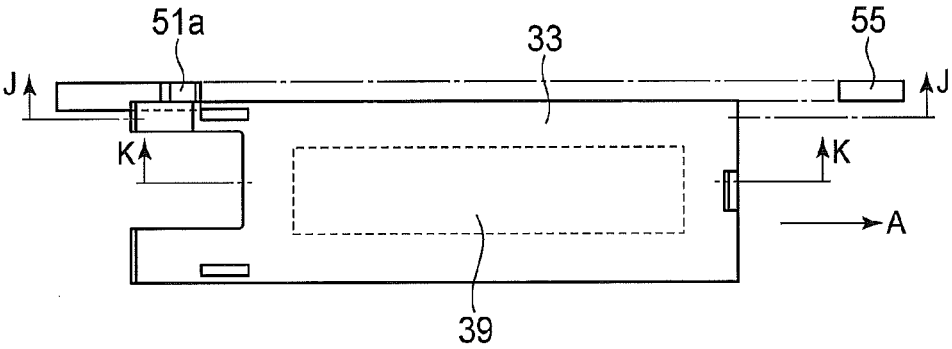

FIGS. 16A, 16B, 17A, and 17B are partial cross-sectional views taken along a line J-J in FIG. 18D and illustrate the operation of the second latch 45 and involved portions from when the tone cartridge 5 begins to be inserted into the toner cartridge supporting unit 41 till the toner cartridge 5 has been inserted completely. FIGS. 18A, 18B, 19A, and 19B are partial cross-sectional views taken along a line K-K in FIG. 18D and illustrate the operation of the latch releasing post 55 and involved portions. FIGS. 19C and 19 illustrate the positional relationship between the shutter 33 and the latch releasing post 55 shortly after the toner cartridge 5 has arrives at the mounting position shown in FIG. 19B.

The features enclosed in small dotted lines in FIGS. 16A, 16B, 17A, 17B, 18A, 18B, 19A, and 19B are shown in expanded views enclosed by large dotted line rectangles. FIGS. 18C and 18D illustrate the positional relationship between the shutter 33 and the latch releasing post 55 shortly after the toner cartridge 5 advances to the position shown in FIG. 16A.

As is clear from FIG. 3, once the front cover 29 of the printer 100 is opened, the four toner cartridge supporting units 41K, 41Y, 41M, and 41C are exposed through the openings. The user places the distal end portion of the toner cartridge 5, which is pointed by the arrow 5*a* marked on the toner cartridge 5, on the supporting surface 42 (FIG. 9). The user then inserts the toner cartridge 5 in an insertion direction in which the toner cartridge moves on the supporting surface 42 with the outer rib 50 (FIG. 6) of the toner cartridge 5 guided by the guides 43. Arrow A shown in FIGS. 16A to 19B indicate the insertion direction.

When the toner cartridge 5 advances to the position shown in FIG. 16A, the shutter 33 of the toner cartridge 5 pushes downward the fourth kinked portion 62*a* of the second latch 45, causing the second latch 45 to resiliently deform as shown in FIGS. 16A and 18A. The shutter 33 remains closed at this time, and the distal end portion 51*a* of the first latch 51 on the toner cartridge 5 is in a recess 33*a* in the shutter 33 (FIGS. 18A and 18C), preventing the shutter 33 from moving relative to the toner cartridge 5 in a direction shown by arrow B. The first latch 51 is formed of a resilient material so that the distal end portion 51*a* can resiliently deform to urge the bottom of the recess 33*a* in the shutter 33.

The toner cartridge 5 further advances to the position shown in FIG. 16B. When the first latch engagement portion 33*c* or trailing end portion of the shutter 33 moves past the projection 62 of the second latch 45 as shown in FIGS. 16B and 18B, the second latch 45 regains some of its original shape, but still urges the shutter 33 against the toner cartridge 5 since the second latch engagement portion 54 remains in engagement with the fourth kinked portion 62*a*. The second latch 45 engages the first latch engagement portion 33*c*, thereby limiting the movement of the shutter 33 in the B direction. However, the second latch 45 has not completely resiliently regained its original shape yet, and the second latch 45 remains in an urging engagement with the bottom of the second latch engagement portion 54. Also, as shown in FIG. 18B, the latch releasing post 55 formed on the toner cartridge supporting unit 41 begins to push up the distal end portion 51*a* of the first latch 51 on the toner cartridge 5, the distal end portion 51*a* gradually moving out of the recess 33*a* formed in the shutter 33.

Figure 19A:
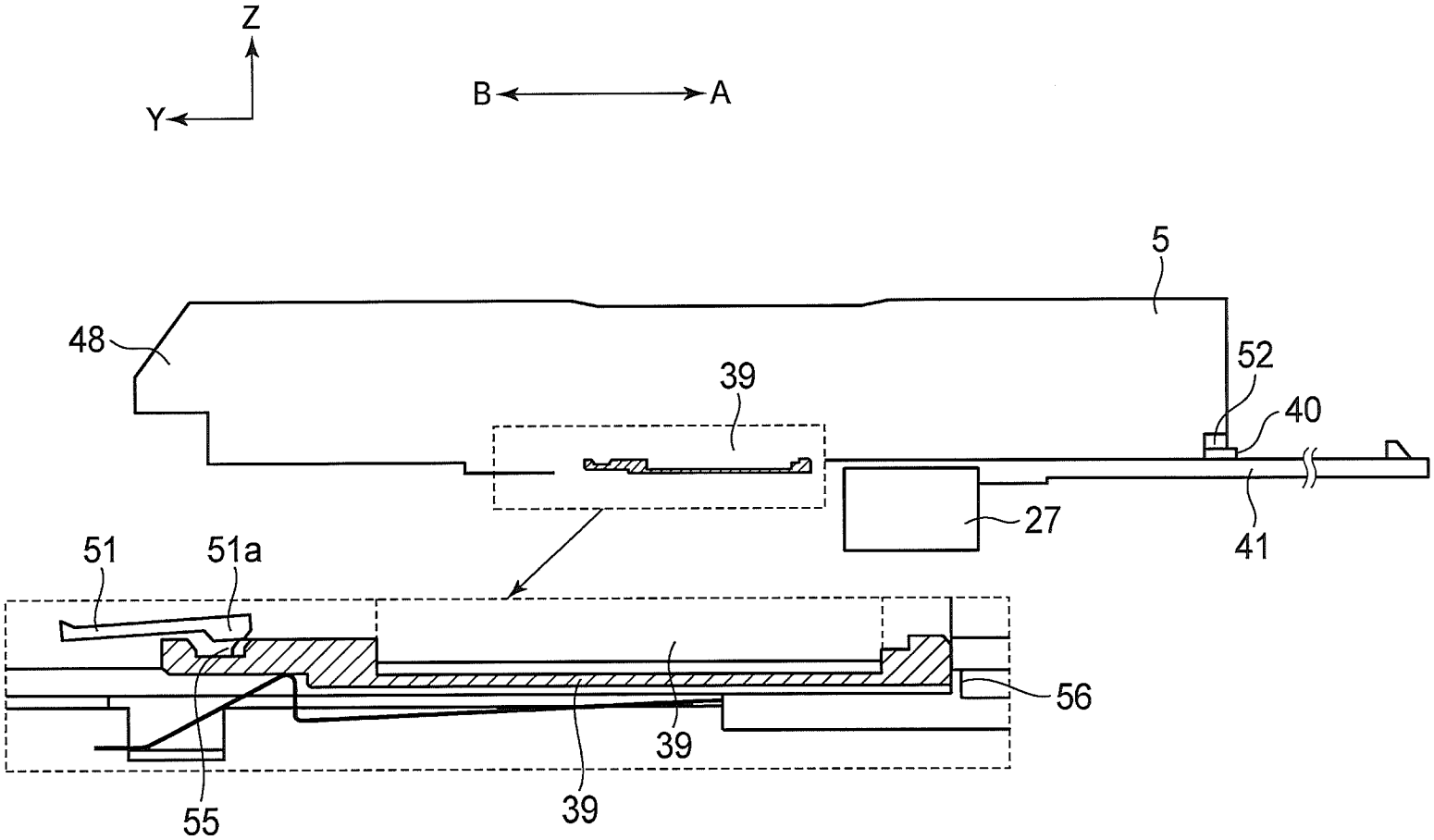

The toner cartridge 5 still further advances to the position shown in FIG. 17A, where the leading end portion 33*b* of the shutter 33 abuts the shutter movement limiting element 56 of the toner cartridge supporting unit 41 as shown in FIGS. 17A and 19A. Thus, the shutter movement limiting element 56 prevents the shutter 33 from advancing any further in the A direction. At this point of time, the fourth kinked portion 62*a* remains in urging engagement with the second latch engagement portion 54 remains in engagement with the fourth kinked portion 62*a* and still urges against the toner cartridge 5. The latch releasing post 55 (FIGS. 9 and 10) allows the first latch 51 to move out of engagement with the shutter 33 as shown in FIG. 19A, so that the shutter 33 is allowed to slide on the toner cartridge 5 relative to the toner cartridge 5 in the B direction. When the toner cartridge 5 even further advances in the A direction, the movement of the shutter 33 in the A direction is limited, so that the longitudinal end portion 33*b* of the shutter 33 moves out of contact engagement with the stopper 57 and the shutter 33 begins to open the toner discharging opening 39 (FIG. 8).

Figure 19B:
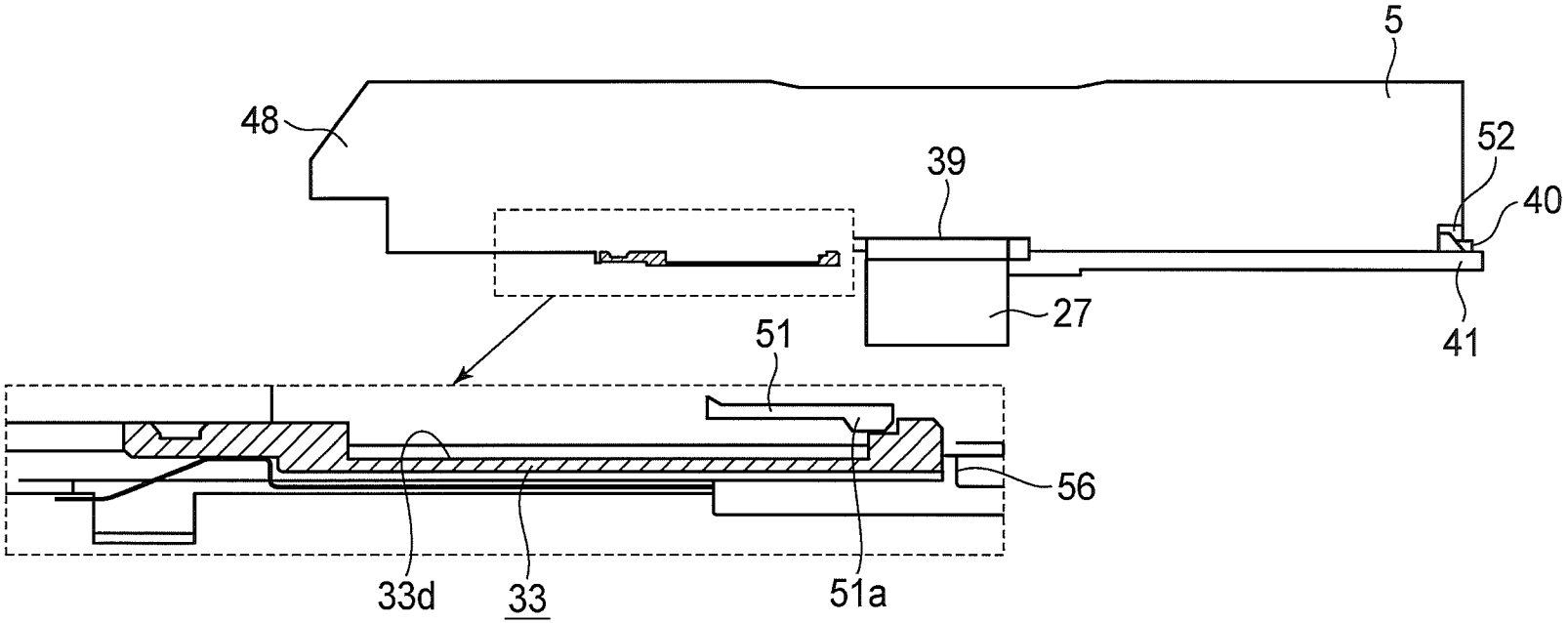
Figure 19C:
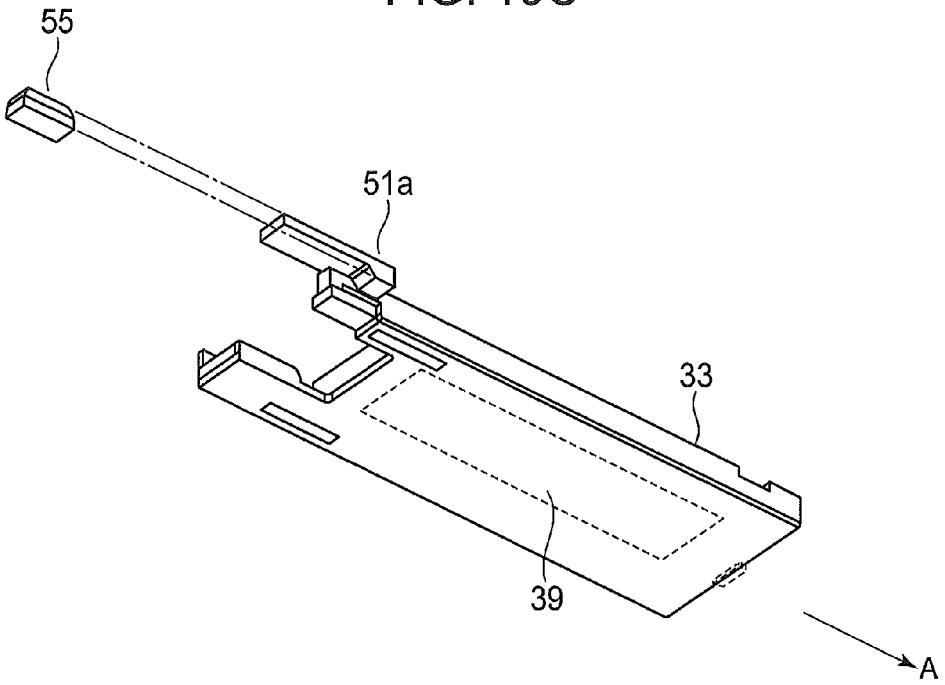

The toner cartridge 5 yet further advances to the position shown in FIG. 17B, so that the positioning post 32 of the toner cartridge 5 fits into a fitting hole (not shown) formed concentrically in the drive gear 37 as shown in FIG. 15B. Simultaneously, the positioning element 44 (FIG. 9) of the toner cartridge supporting unit 41 fits into and abuts the limiting groove 52, so that the toner cartridge 5 is finally placed in position relative to the toner cartridge supporting unit 41 as shown in FIG. 19B. The position of the toner cartridge 5 relative to the toner cartridge supporting unit 41 as shown in FIGS. 17B and 19B is referred to as a "cartridge mounting position." At this time, the bottom of the second latch engagement portion 54 has moved past the projection 62 of the second latch 45 so that the second latch 45 resiliently regains its original shape completely and the abutment wall 62*c* limits movement of the end of the second latch engagement portion 54 in the B direction. This prevents inadvertent pull-out of the toner cartridge 5. There is a small gap between the abutment wall 62*c* and the first latch engagement portion 33*c* or the longitudinal end portion of the shutter 33 so that the shutter 33 is loosely sandwiched between the abutment wall 62*c* and the shutter movement limiting element 56.

Figure 19D:
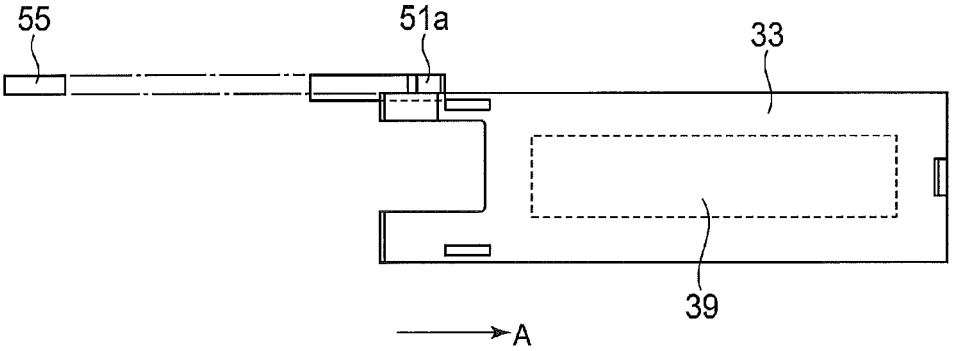

As the toner cartridge 5 approaches the cartridge mounting position, the distal end portion 51*a* of the first latch 51 climbs over the latch releasing post 55 and then resiliently drops into the recess 33*d* (FIG. 19B), the shutter advancing together with the toner cartridge in the A direction so that the latch releasing post 55 is left behind as shown in FIGS. 19C and 19D. When the toner cartridge 5 is at the cartridge mounting position, the toner cartridge identifier 40 of the toner cartridge 5 is in contact with the contact 46 as shown in FIG. 17B.

The drive gear 37 is movable together with its shaft in the direction in which the shaft extends. The drive gear 37 is urged by a coil spring 38 in the B direction and is stopped at a predetermined position. Once the toner cartridge 5 has arrived at the cartridge mounting position, the gears 34*a* and 34*b* abuts the drive gear 37, and then push the drive gear 37 in the A direction so that the drive gear 37 is pushed back as shown in FIG. 15B. When the drive gear 37 is pushed in the in the A direction, the gears 34*a* and 34*b* may not be in a meshing engagement with the drive gear 37. However, once the drive gear 37 starts to rotate, the gears 34*a* and 34*b* will move into a meshing engagement with the drive gear 37 at a proper timing, the drive gear 37 moving back in the B direction to its original position as shown in FIG. 15A.

A sensor detects when the front cover 29 (FIG. 3) is closed shortly after the toner cartridge 5 has arrived at the cartridge mounting position, and then a decision is made to determine whether communication may be made between the toner cartridge identifier 40 and the printer 100. If communication may be made, then it is determined that the toner cartridge 5 has been attached properly into the toner cartridge supporting unit 41, and a printing operation is allowed. If communication fails, then it is determined that the toner cartridge 5 has not been attached properly into the toner cartridge supporting unit 41, and a printing operation is not allowed.

Figure 21A:
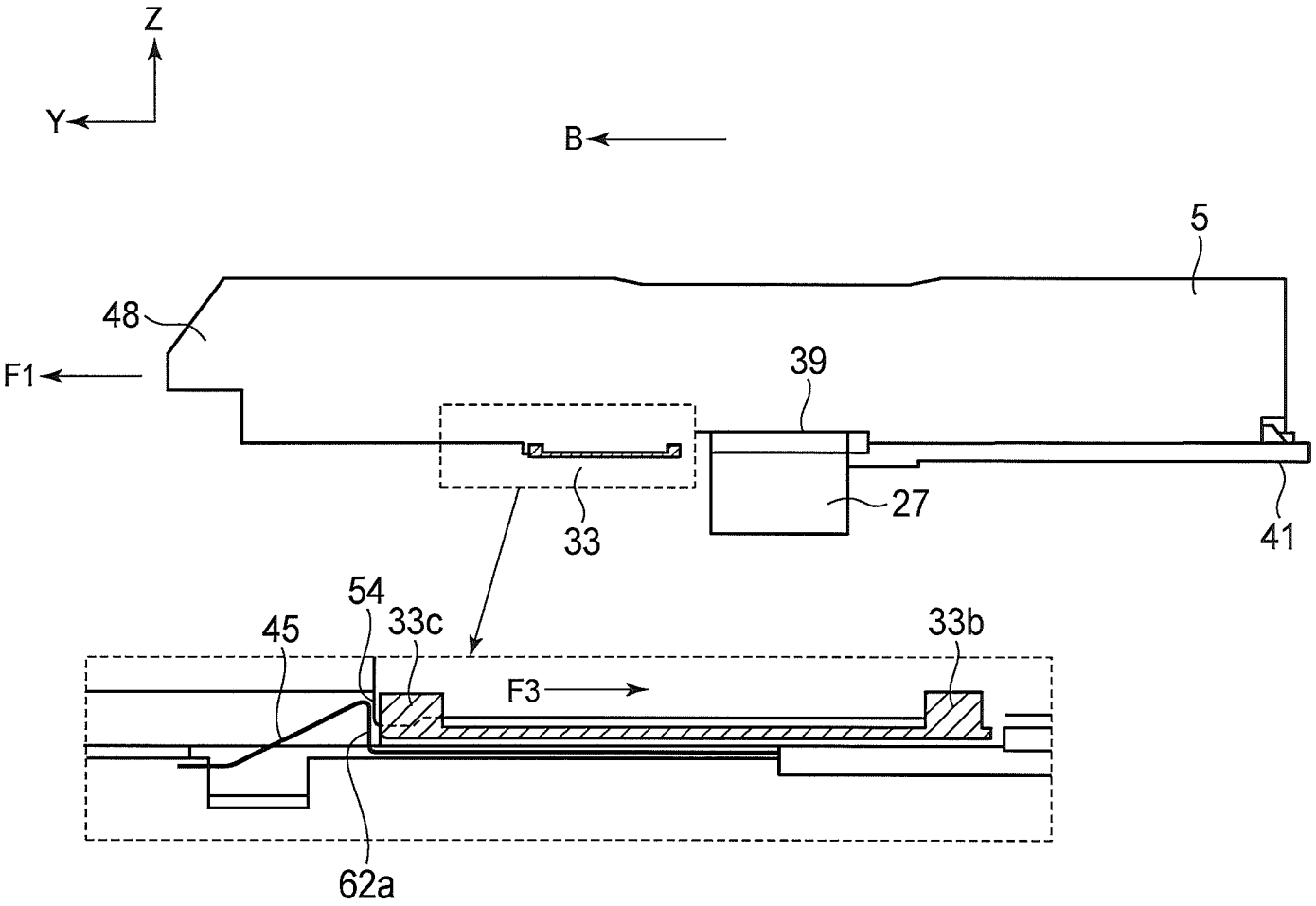
FIGS. 21A and 21B illustrate the operation.
Figure 21B:
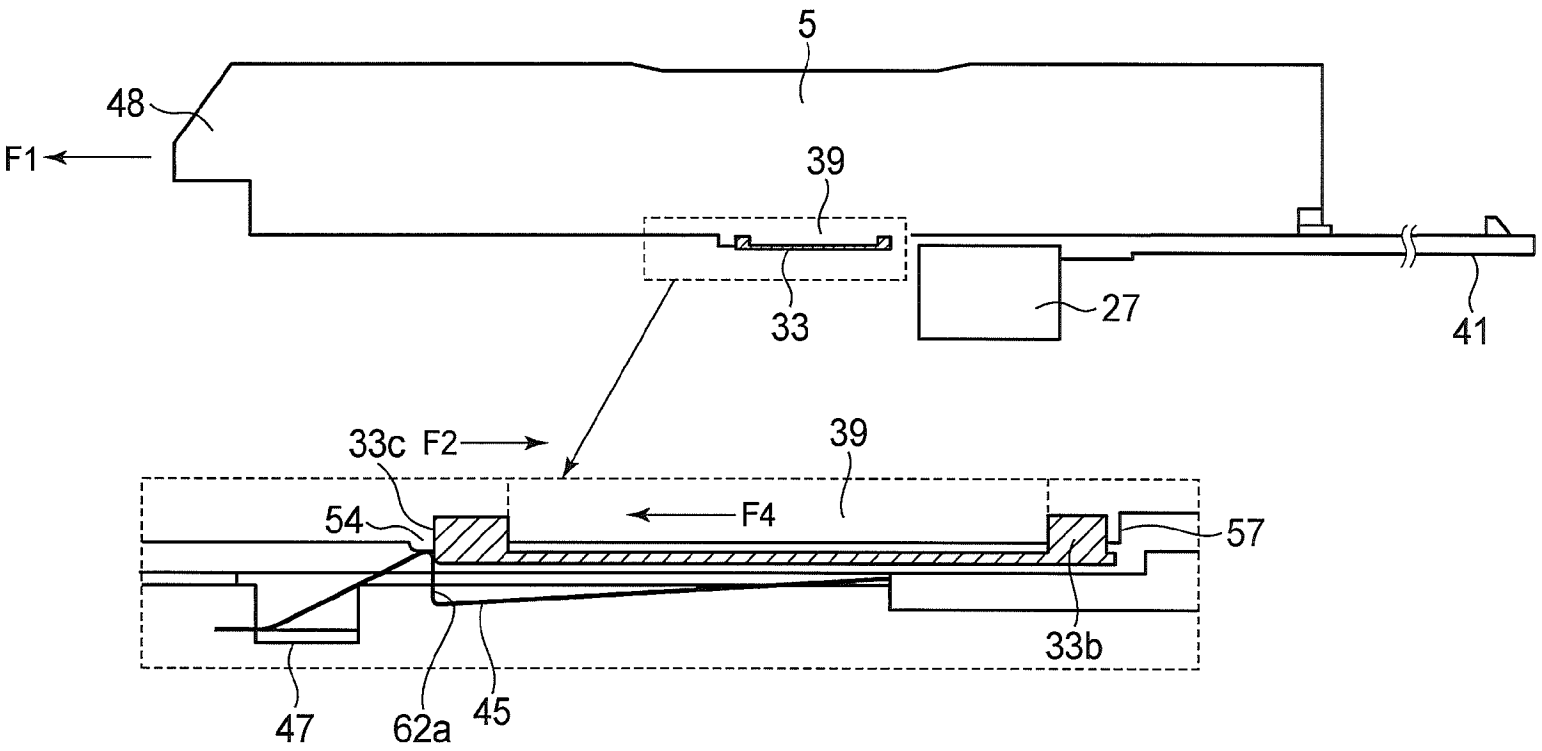

Next, a description will be given of the operation in which the toner cartridge 5 is pulled out of the printer 100. FIGS. 21A and 21B illustrate the operation. The features enclosed in small dotted lines in FIGS. 16A, 16B, 17A, and 17B are shown in expanded views enclosed by large dotted line rectangles.

The user first opens the front cover 29 (FIG. 3) of the printer 100, and then grasps the handhold 48 (FIG. 7) of the toner cartridge 5 to draw the toner cartridge 5 from the toner cartridge supporting unit 41 in a pull-out direction shown by arrow B. The abutment wall 62*c* (FIGS. 20A and 20B) of the second latch 45 is caught by the end of the second latch engagement portion 54 of the toner cartridge 5 as shown in FIG. 21A, thereby preventing the toner cartridge 5 from moving in the B direction so that the toner cartridge 5 is not pulled out. However, if the force F1 with which the user pulls the handhold 48 is larger than the force F3 that the second latch 45 pushes back against the second latch engagement portion 54, i.e., F1>F3, the second latch 45 resiliently deforms so that the abutment wall 62*c* moves out of engagement with the second latch engagement portion 54. This allows the user to pull the toner cartridge 5 in the B direction from the position shown in FIG. 21A to the position shown in FIG. 21B.

When the toner cartridge 5 arrives at the position shown in FIG. 21B, the projection 62 of the second latch 45 is in an urging engagement with the bottom of the second latch engagement portion 54, and also engages the first latch engagement portion 33*c* or the longitudinal end portion of the shutter 33, thereby preventing the shutter 33 from moving in the B direction so that the shutter 33 stays where it is. Due to the fact that the toner cartridge 5 moves in the B direction while the shutter 33 stays where it is, the toner discharging opening 39 (FIG. 8) begins to be closed. The longitudinal end portion 33*b* of the shutter 33 will then abut the stopper 57 as shown in FIG. 21B, so that the toner discharging opening 39 is completely closed.

When the user pulls the toner cartridge 5 further from the position shown in FIG. 21B, the second latch 45 applies a force F2 to the first latch engagement portion 33*c* or the longitudinal end portion of the shutter 33. If the user applies the force F1 larger than the force F2, i.e., F1>F2, the second latch 45 further resiliently deforms so that the first latch engagement portion 33*c* moves out of engagement with the second latch 45. This allows the user to pull the toner cartridge 5 out of the printer 100 in the B direction, while the shutter 33 remaining closed.

Meanwhile, when the toner cartridge 5 is at the cartridge mounting position as shown in FIG. 21A, the first latch 51 (FIG. 19B) formed on the toner cartridge 5 is positioned in the vicinity of the shutter movement limiting element 56. When the toner cartridge 5 arrives at the position shown in FIG. 21B, the shutter closes the toner discharging opening 39 completely and the stopper 57 abuts the longitudinal end portion 33*b* of the shutter 33. At this time, the distal end portion 51*a* of the first latch 51 has climbed over the latch releasing post 55 and is in the recess 33*a*, thereby preventing the toner cartridge 5 from moving in the B direction.

The user may pull the toner cartridge 5 further from the position shown in FIG. 21B, thereby pulling the toner cartridge 5 completely out of the printer 100.

FIGS. 22A-22D and 23A-23D illustrate the relationship among the forces acting on the second latch 45, the first latch engagement portion 33*c*, the second latch engagement portion 54, and the displacement limiting element 47 (FIG. 16) when the user pulls the toner cartridge 5 out of the toner cartridge supporting unit 41. As described previously, the following forces are acting.

F1 is the force applied to the handhold 48 when the user pulls the handhold 48 toward him.

F2 is the force applied to the first latch engagement portion 33*c* by the second latch 45.

F3 is the force applied to the second latch engagement portion 54 by the second latch 45.

Figure 22A:
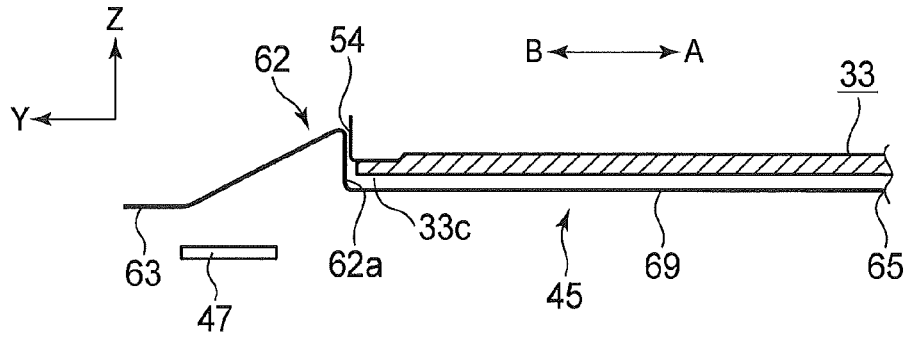
FIGS. 22A-22D and 23A-23D illustrate the relationship among the forces acting on the second latch, a first latch engagement portion, a second latch engagement portion, and a displacement limiting element when the user pulls the toner cartridge out of the toner cartridge supporting unit.
Figure 22B:
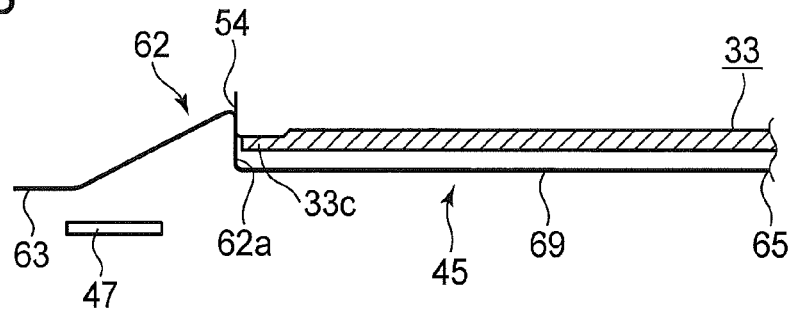

When the toner cartridge 5 has been attached completely in the toner cartridge supporting unit 41 as shown in FIG. 22A, if the user attempts to pull the toner cartridge 5 out of the toner cartridge supporting unit 41, the second latch engagement portion 54 moves into a contact engagement with the abutment wall 62*c* of the projection 62 of the second latch 45 as shown in FIG. 22B, so that the resiliently deformable portion 69 of the second latch 45 is stretched taut since the second latch 45 is secured at the securing portion 61 (FIG. 20A). At this time, the second latch 45 does not resiliently deform significantly yet.

Figure 22C:
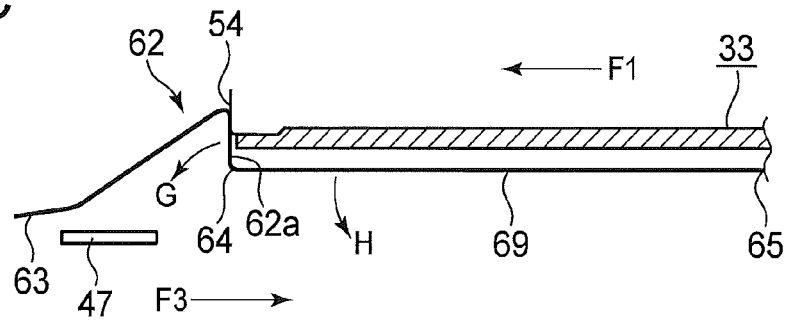
Figure 22D:
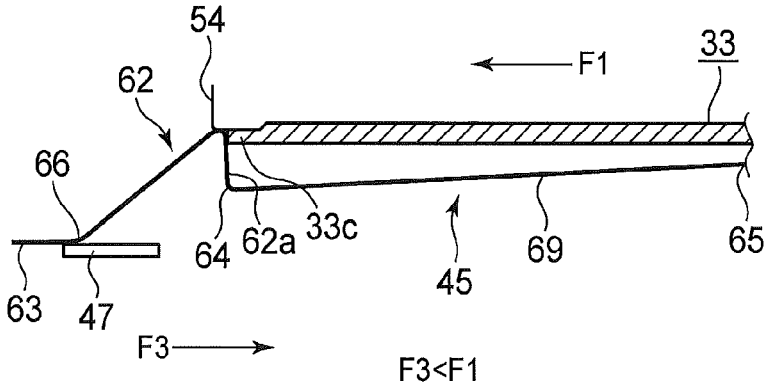

As the force F1 increases, the second latch 45 starts to resiliently deform so that the projection 62 starts to incline in a direction shown by arrow G and the resiliently deformable portion 69 starts to resiliently deform by a direction shown by arrow H as shown in FIG. 22C. Once the resilient deformation of the second latch 45 satisfies a condition such that F1>F3, only the projection 62 moves out of engagement with the second latch engagement portion 54 as shown in FIG. 22D.

At this time, the free end portion 63 of the second latch 45 abuts the displacement limiting element 47, so that the free end portion 63 is prevented from moving further downward, and the abutment wall 62*c* of the projection 62 interferes with the first latch engagement portion 33*c*, preventing the shutter 33 from moving in the B direction. The projection 62 is in pressure contact with the bottom of the second latch engagement portion 54 due to the resilient deformation of the second latch 45.

Figure 23A:
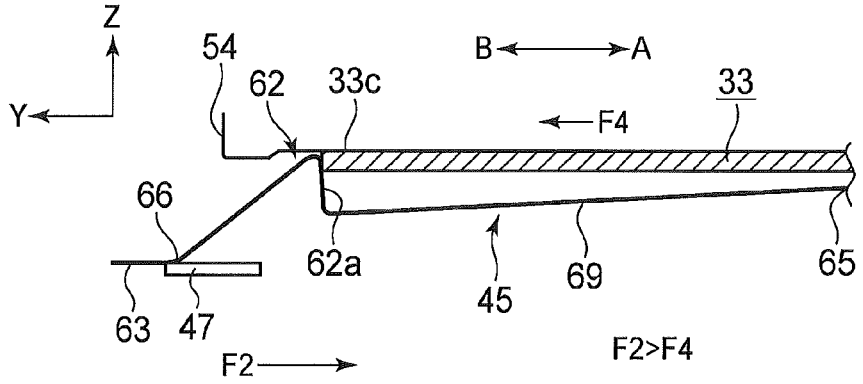

At this time, if the user tries to pull out the toner cartridge 5 further, only the main body of the toner cartridge 5 moves in the B direction as shown in FIG. 23A, causing the shutter 33 to close the toner discharge opening 39 (FIG. 8). The shutter 33, which moves relative to the main body of the toner cartridge 5, experiences a force F4 in the B direction due to friction. Therefore, the force F2 applied to the first latch engagement portion 33*c* by the second latch 45 and the force F4 which causes the shutter 33 to move need to be selected such that F2>F4.

Figure 23B:
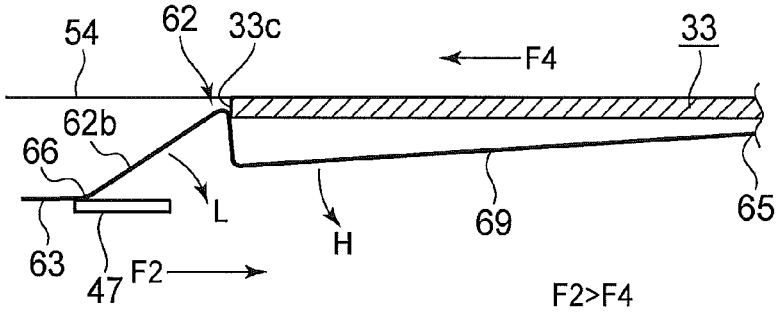

Once the stopper 57 of the toner cartridge 5 abuts the longitudinal end portion 33*b* of the shutter 33 to close the toner discharging opening 39, the force F1 is transmitted to the shutter 33, so that the first latch engagement portion 33*c* presses the abutment wall 62*c* of the projection 62 of the second latch 45 as shown in FIG. 23B. At this time, the second latch 45 pivots about the second kinked portion 65 in the H direction while also resiliently flexing, and the inclined portion 62*b* pivots about the third kinked portion 66 in a direction shown by arrow L while also resiliently flexing.

Figure 23C:
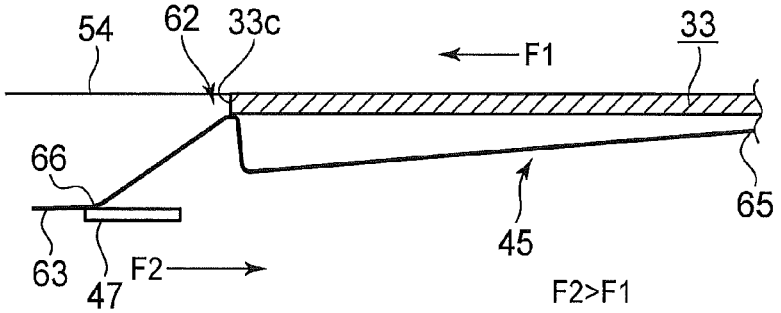
Figure 23D:
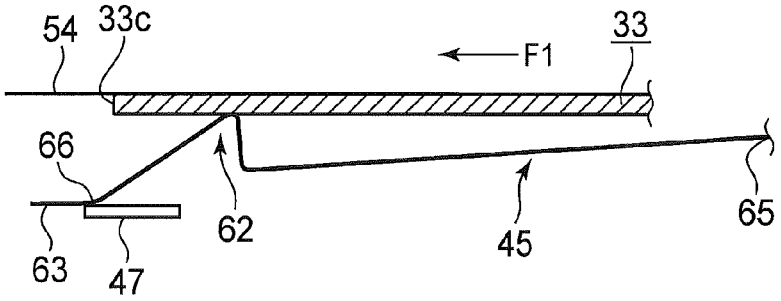

As described above, the resilient deformation of the second latch 45 satisfies the relationship such that F1>F2, the projection 62 moves out of engagement with the first latch engagement portion 33*c* as shown in FIG. 23C. Subsequently, when the toner cartridge 5 is further pulled out of the toner cartridge supporting unit 41, the closed shutter 33 slides on the projection 62 of the second latch 45 in the B direction as shown in FIG. 23D so that the entire toner cartridge 5 will be pulled out of the printer 100.

Employment of the displacement limiting element 47 is effective in increasing the force F2 since the displacement limiting element 47 limits the movement of the free end portion 63 of the second latch 45 in the downward direction (Z direction). This configuration ensures that F2>F4, so that the toner cartridge 5 is prevented from being pulled out with the shutter partially opened.

Figure 24:
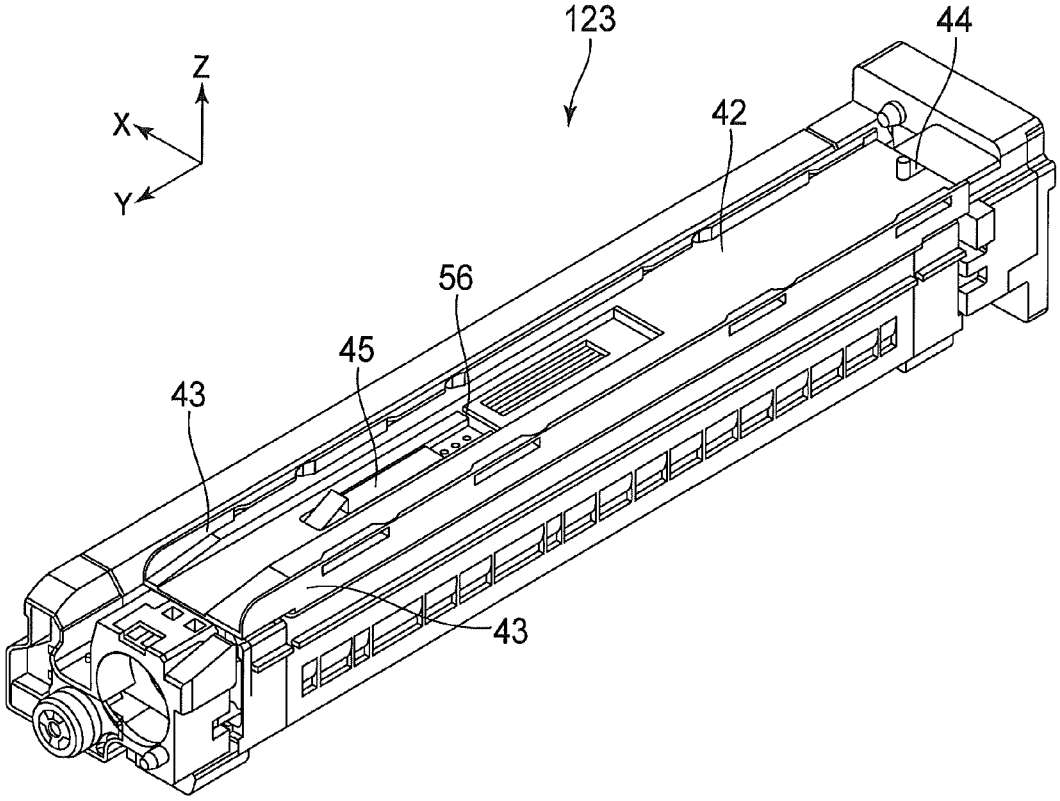
FIG. 24 shows an image forming section which is a modification to the image forming section to the first embodiment.

As described above, the toner cartridge supporting unit 41 and the developing unit 10 are separate apparatus and are securely attached to the printer 100. The toner is directed into the developing unit 10 through the toner supplying path 27. The present invention is not limited to this configuration. For example, FIG. 24 shows an image forming section 123 (toner cartridge is not shown) which is a modification to the image forming section 23. Specifically, the image forming section 123 performs a function of the toner cartridge supporting unit without the toner supplying path 27. In other words, the image forming section 123 and the toner cartridge supporting unit may be formed in a unitary construction.

As described above, when the user attaches the toner cartridge 5 into or detaches the toner cartridge 5 from the body of the printer 100, the user only needs to move the toner cartridge 5 straightly relative to the printer 100. As a result, the shutter 33 automatically opens or closes the toner discharging opening 39 while preventing inadvertent pull-out of the toner cartridge 5 from the printer 100. This provides simple replacement and easy handling of the toner cartridge.

When the cartridge 5 is being taken out of the body of the printer 100, the first latch engagement portion 33*c* abuts the abutment wall 62*c* of the projection 62 to hamper the pull-out operation of the toner cartridge 5, so that the toner cartridge 5 may be pulled out slowly. This operation prevents the toner cartridge 5 from being inadvertently dropped, which would otherwise be caused by the user's quick, fast pulling operation.

Second Embodiment

Figure 25:
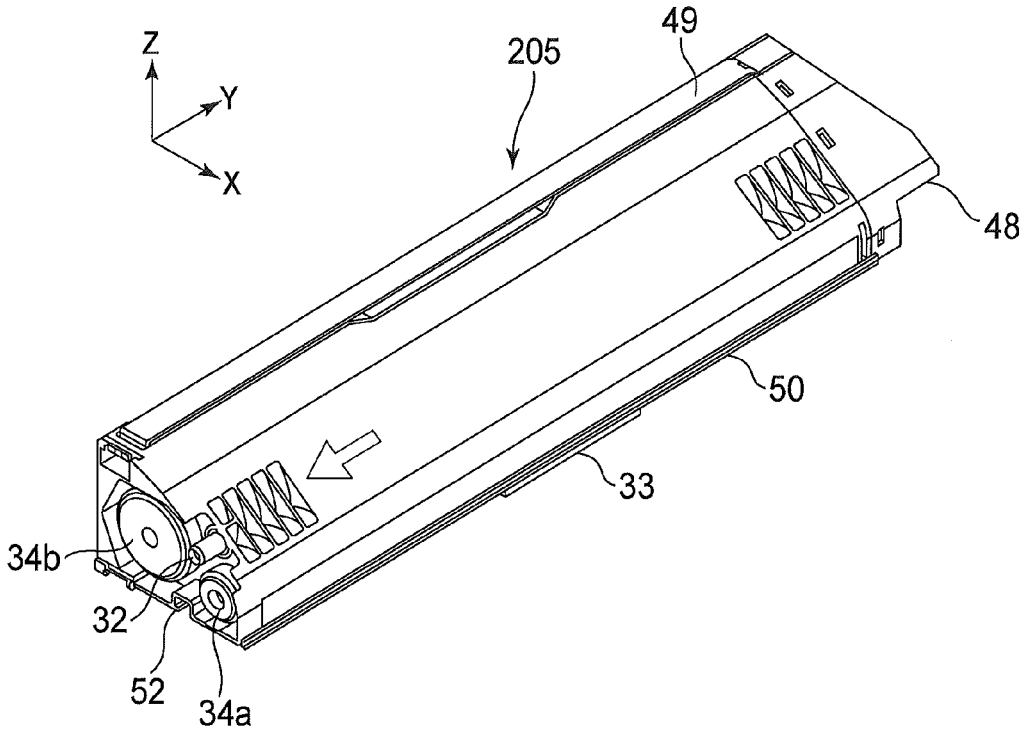
FIGS. 25 and 26 are perspective views of a toner cartridge according to a second embodiment as seen from different directions.
Figure 26:
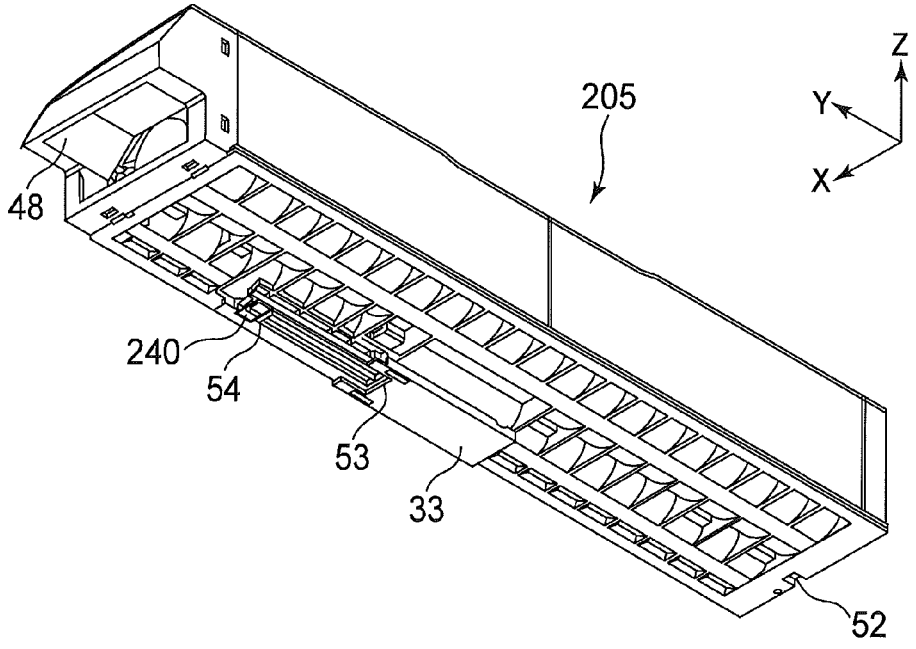
Figure 27:
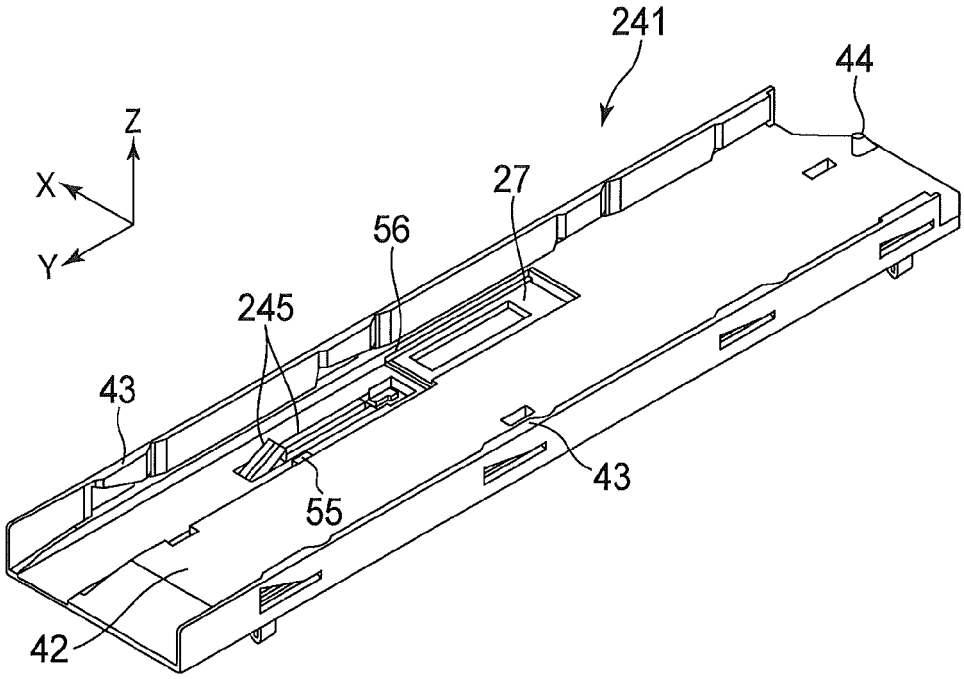
FIGS. 27 and 28 are perspective views of the toner cartridge supporting unit according to the second embodiment as seen from different directions.
Figure 28:
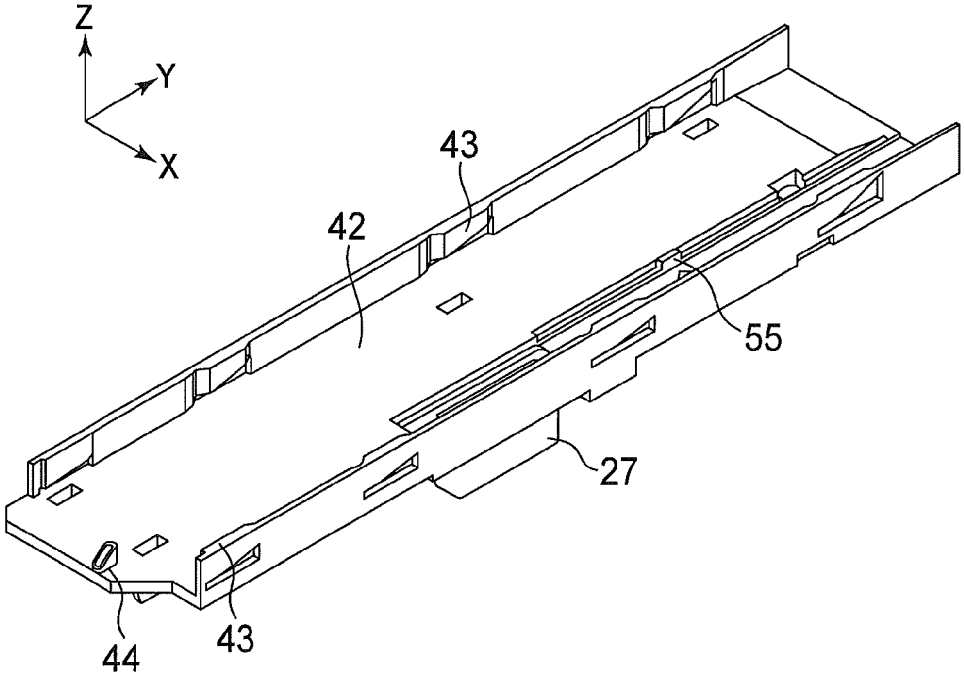

FIGS. 25 and 26 are perspective views of a toner cartridge 205 according to a second embodiment as seen from different directions, illustrating a toner cartridge 205 and a toner cartridge supporting unit 241 according to a second embodiment. FIGS. 27 and 28 are perspective views of a toner cartridge supporting unit 241 according to a second embodiment as seen from different directions.

The printer according to the second embodiment only differs from that of the first embodiment shown in FIG. 2 in that image forming sections employ the toner cartridge 205 and toner cartridge supporting unit 241. Elements similar to those of the printer according to the first embodiment have been given like reference characters and their detailed description is omitted. A description will be given of only portions different from those of the first embodiment. The pertinent portions of the second embodiment except for the toner cartridge 205 and the toner cartridge supporting unit 241 are common to those of the image forming section 23 shown in FIG. 2. Thus, the second embodiment will be described with reference to FIGS. 1 to 3 as required.

Referring to FIG. 26, a toner cartridge identifier 240 of the toner cartridge 205 is disposed in the vicinity of a second latch engagement portion 54, and is closer to a handhold 48 than the second latch engagement portion 54. FIG. 27 illustrates two second latches 245. Each second latch 245 has the same shape as the second latch 45 but differs from the second latch 45 in that the second latch 245 has a narrower width than the second latch 45, and is gold plated.

The operations of the second latch 245, the first engagement portion 33*c*, and the second latch engagement portion 54 when the toner cartridge 205 is inserted into and pulled out of the printer are the same as those of the first embodiment and their detailed description is omitted.

FIGS. 29 and 30 illustrate the operation of the second latch 245 and involved portions from when the toner cartridge 205 begins to be inserted till the toner cartridge 205 has been attached completely.

Figure 29A:
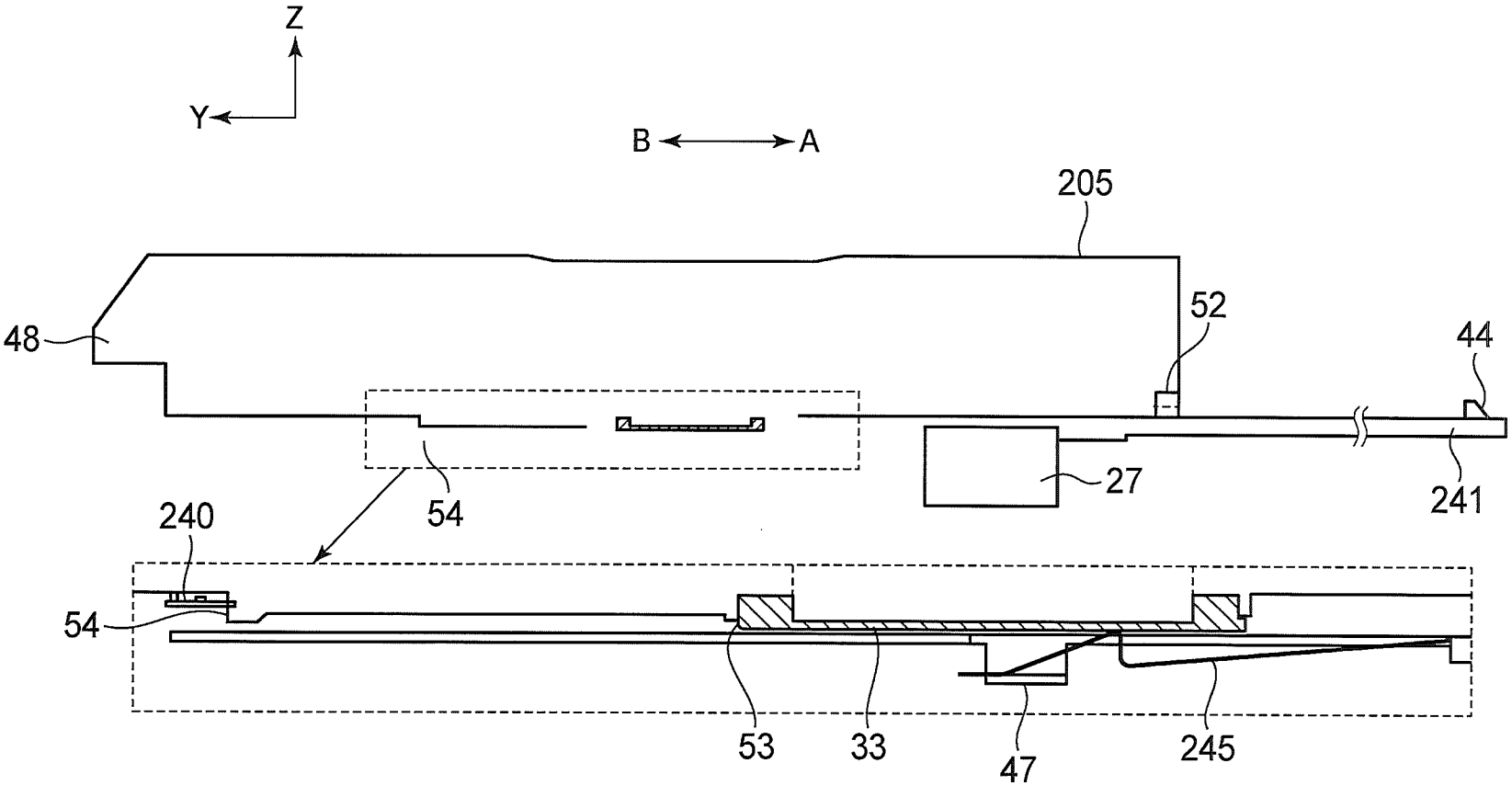
FIG. 29A illustrates the toner cartridge of FIGS. 25 and 26 that has been inserted partially into the toner cartridge supporting unit until the shutter presses the second latch
Figure 29B:
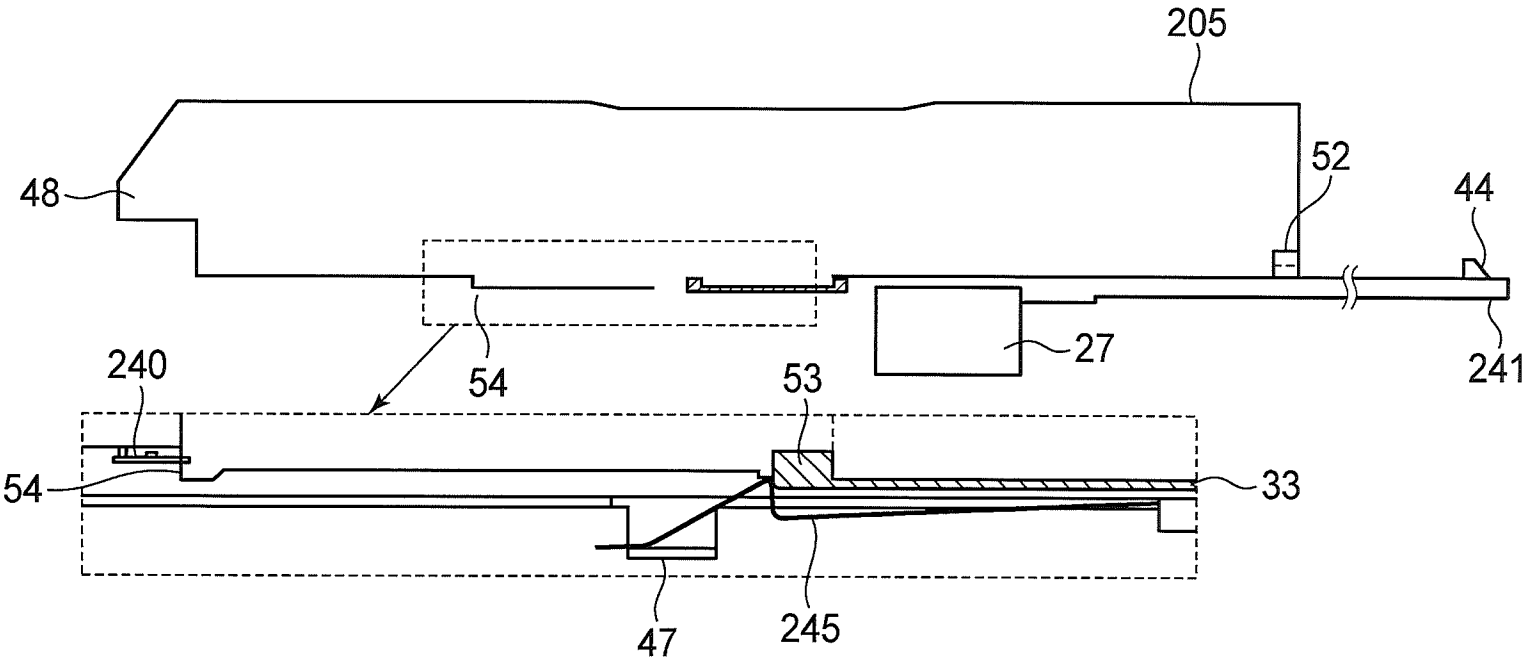
FIG. 29B illustrates the toner cartridge that has been inserted further into the toner cartridge supporting unit until the second latch engages the first engagement portion to limit the movement of the shutter in the B direction.
Figure 30A:
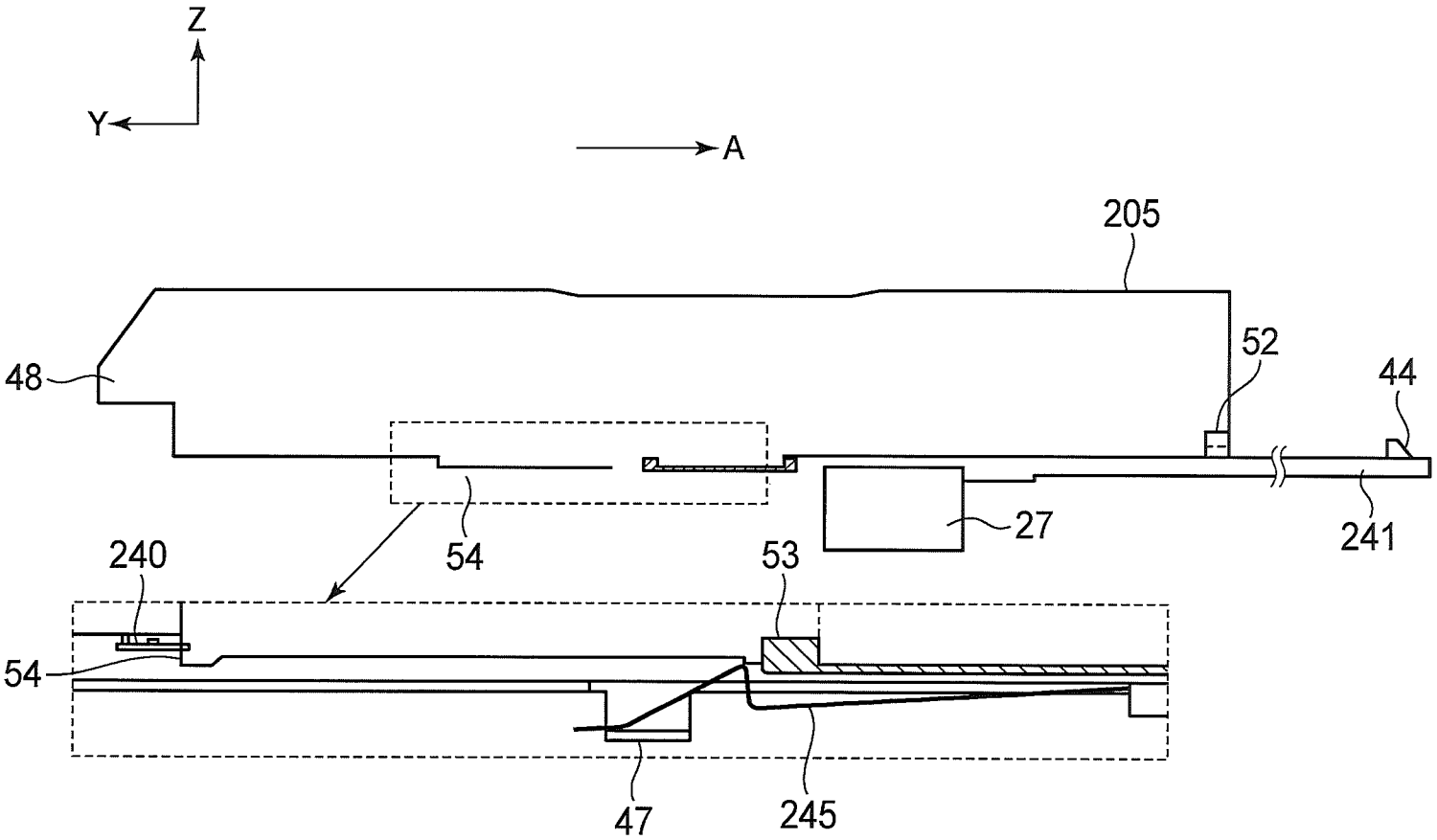
FIG. 30A illustrates the free end or the longitudinal end portion of the shutter that abuts the shutter movement limiting element.
Figure 30B:
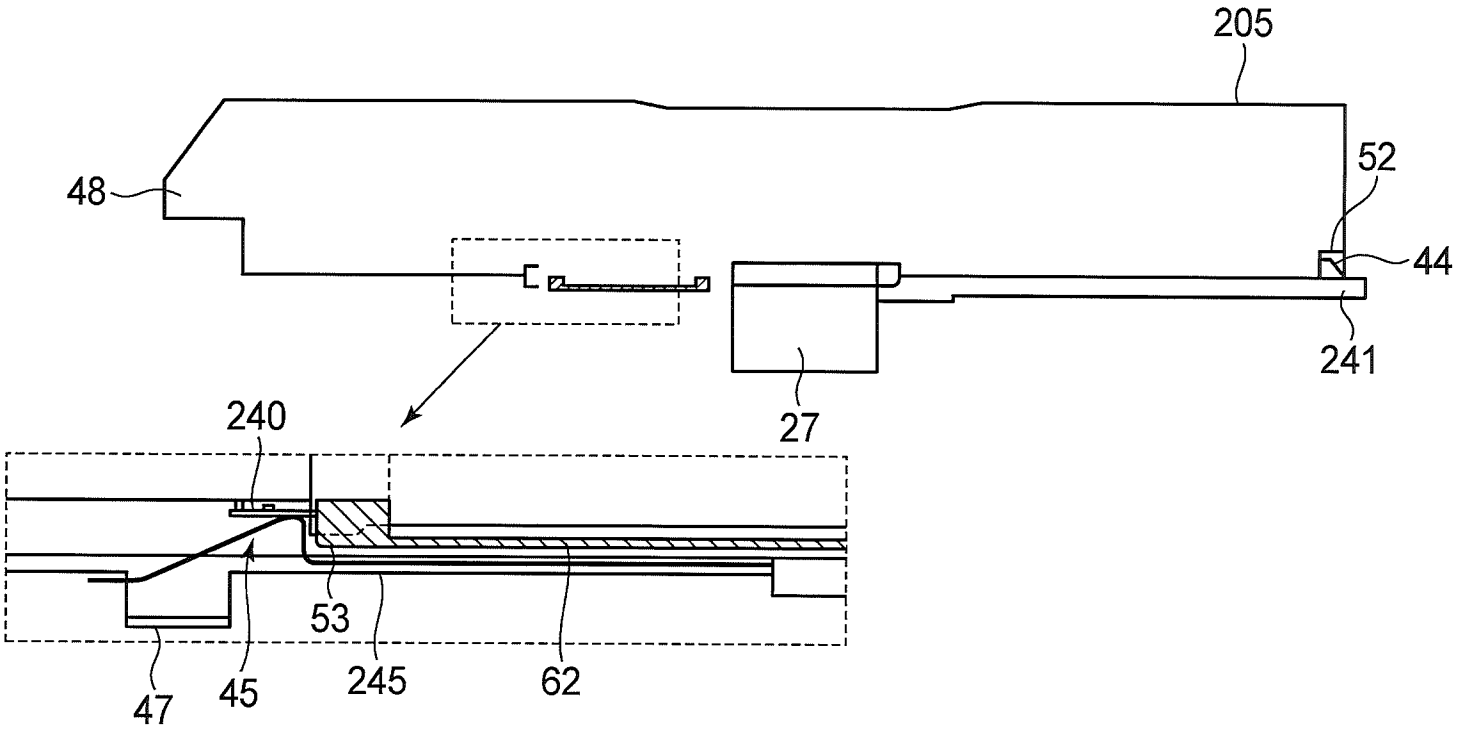
FIG. 30B illustrates the toner cartridge that has moved to a cartridge mounting position.

FIG. 29A illustrates the toner cartridge 205 that has been inserted partially into the toner cartridge supporting unit 241 until the shutter 33 presses the second latch 245, causing the second latch 245 to resiliently deform downward (similar to FIG. 16A). FIG. 29B illustrates the toner cartridge 205 that has been inserted further into the toner cartridge supporting unit 241 until the second latch 245 engages the first engagement portion 33*c* to limit the movement of the shutter 33 in the B direction (similar to FIG. 16B). FIG. 30A illustrates the free end or the longitudinal end portion 33*b* of the shutter 33 that abuts the shutter movement limiting element 56 (FIG. 17) disposed on the toner cartridge supporting unit 241, preventing the shutter 33 from further moving in the A direction (FIG. 17A). FIG. 30B illustrates the toner cartridge 205 that has moved to a cartridge mounting position where the toner cartridge 205 is placed in position relative to the toner cartridge supporting unit 241 and a substantially vertical abutment wall 62*c* of the second latch 245 limits the movement of the end of the second latch engagement portion 54 to prevent the toner cartridge 204 from moving in the B direction (FIG. 17B).

At this moment, the second latch 245 resiliently deforms back to its original shape as shown in FIG. 30B, so that the projection 62 moves into an electrical contact engagement with the toner cartridge identifier 240 in the vicinity of the engagement portion 54. In this manner, the second latch 245 moves into electrically contact with the toner cartridge identifier 240, allowing the printer to communicate with the toner cartridge identifier 205.

When the toner cartridge 205 takes up the cartridge mounting position, if the front cover 29 (FIG. 3) is closed, a decision is made to determine whether the printer can communicate with the toner cartridge identifier 240. If the answer is YES, printing is allowed. If the answer is NO, it is determined that the toner cartridge 205 has not been properly attached, and printing is not allowed.

As described above, the second latch 245 serves as an electrical contact through which the printer is connected electrically to the toner cartridge identifier 240. This provides simple configuration and leads to cost reduction.

While the first and second embodiments have been described in terms of an electrophotographic color printer, the present invention is not limited to this but may be applied to image forming apparatus including a copying machine, a facsimile machines, and a multifunction printer (MFP), which form images on a recording medium based on electrophotography. In addition, although the invention has been described with respect to a color printer, the invention is not limited to this, but may be applicable to monochromatic printer.

What is claimed is:

1. A supporting apparatus configured to hold a developer material holding apparatus that is mounted on the supporting apparatus, the developer material holding apparatus including a shutter configured to open and close a developer material discharging opening formed in the developer material holding apparatus, the supporting apparatus comprising:

a supporting surface that supports the developer material holding apparatus thereon;

a first limiting element that limits movement of the developer material holding apparatus in an insertion direction in which the developer material holding apparatus is inserted into the supporting apparatus;

a shutter movement limiting element that limits movement of the shutter in the insertion direction;

a second limiting element that limits movement of the developer material holding apparatus in a pull-out direction in which the developer material holding apparatus is pulled out of the supporting apparatus and movement of the shutter in the pull-out direction, the pull-out direction being opposite to the insertion direction, the second limiting element being resiliently deformable and extending in the pull-out direction, the second limiting element including a securing portion at which the second limiting element is secured to a portion of the supporting apparatus, a free end portion, and a projection that is located between the securing portion and the free end portion, the securing portion, the projection and the free end portion being disposed such that the securing portion is most upstream with respect to the pull-out direction and the free end portion is most downstream with respect to the pull-out direction, the projection projecting toward the developer material holding apparatus in a direction substantially perpendicular to the pull-out direction; and a third limiting element that limits displacement of the free end portion when the second limiting element resiliently deforms, wherein as the developer material holding apparatus is pulled out in the pull-out direction, a part of the developer material holding apparatus climbs over the projection, causing the second limiting element between the projection and the securing portion to resiliently deform until the free end portion abuts the third limiting element and the projection abuts the shutter;

wherein as the developer material holding apparatus is further pulled out in the pull-out direction after the projection has abutted the shutter, the shutter climbs over the projection causing the second limiting element between the projection and the free end portion to resiliently deform, and then the shutter moves together with the developer material holding apparatus in the pull-out direction.

2. The supporting apparatus according to claim 1, wherein when the developer material holding apparatus moves in the insertion direction, the shutter movement limiting element causes a body of the developer material holding apparatus to move relative to the shutter in the insertion direction after the developer material holding apparatus has been inserted a distance into the supporting apparatus.

3. The supporting apparatus according to claim 1, wherein when the developer material holding apparatus receives a first amount of force in the pull-out direction greater than a first reference value, the second limiting element allows the developer material holding apparatus to move in the pull-out direction.

4. The supporting apparatus according to claim 1, wherein when the developer material holding apparatus moves in the pull-out direction, the second limiting element limits movement of the shutter in the pull-out direction until the developer material discharging opening is closed by the shutter.

5. The supporting apparatus according to 4, wherein when the developer material holding apparatus receives an amount of force in the pull-out direction greater than a reference value after the developer material discharging opening has been closed by the shutter, the second limiting element allows the shutter to move further in the pull-out direction.

6. The supporting apparatus according to claim 1, wherein the supporting apparatus further includes a developer material supplying path, wherein when the developer material holding apparatus is at a position relative to the supporting apparatus where the movement of the developer material holding apparatus relative to the supporting apparatus is limited by the first limiting element and the second limiting element, the developer material discharging opening directly faces the developer material supplying path so that developer material is discharged through the developer material discharging opening and is guided by the developer material supplying path.

7. The supporting apparatus according to claim 1, further comprising a guide that guides the developer material holding apparatus when the developer material holding apparatus moves in the pull-out direction and in the insertion direction.

8. The supporting apparatus according to claim 1, further comprising:

an image bearing body on which an electrostatic latent image is formed; and a developing mechanism configured to develop the electrostatic latent image into a visible image.

9. An image forming apparatus comprising:

the supporting apparatus according to claim 1; and the developer material holding apparatus according to claim 1, the developer material holding apparatus being detachably attached to said supporting apparatus, the developer material holding apparatus having a chamber that holds the developer material therein, the developer material being discharged from the chamber through said developer material discharging opening, a first engagement portion formed on the shutter, wherein when the developer material holding apparatus is moved in the pull-out direction, the first engagement portion engages the second limiting element so as to limit movement of the shutter in the pull-out direction; and a second engagement portion formed on a body of the developer material holding apparatus, wherein when the developer material holding apparatus is moved in the pull-out direction, the second limiting element engages the second engagement portion so as to limit movement of the shutter in the pull-out direction, wherein the shutter is slidably mounted on said body.

10. The image forming apparatus according to claim 9, wherein the developer material holding apparatus further comprises a handhold used when the developer material holding apparatus is pulled out of the supporting apparatus.

11. The image forming apparatus according to claim 9, wherein the developer material holding apparatus further comprises a fourth limiting element configured to limit the shutter at a position where the shutter closes the developer material discharging opening.

12. An image forming apparatus comprising:

the supporting apparatus according to claim 1.

13. The image forming apparatus according to claim 12, wherein a receiving space is formed in the image forming apparatus and includes an opening through which the developer material holding apparatus is inserted into the supporting apparatus, and the image forming apparatus further comprises a cover configured to open and close the opening.

14. The supporting apparatus according to claim 1, wherein the projection includes an inclined portion that extends across the free end portion and a top end of the projection.

15. The supporting apparatus according to claim 14, wherein the inclined portion resiliently deforms when the developer material holding apparatus is further pulled out after the projection has abutted the shutter.

16. The supporting apparatus according to claim 15, wherein the second limiting element includes a pivot portion between the free end portion and the inclined portion, the inclined portion resiliently deforming about the pivot portion.

17. The supporting apparatus according to claim 1, wherein the second limiting element resiliently deforms when the developer material holding apparatus is pulled out with a first amount of force, and the second limiting element between the projection and the free end portion resiliently deforms when the developer material holding apparatus is further pulled out with a second amount of force larger than the first amount of force after the projection has abutted the shutter.

18. A supporting apparatus configured to hold a developer material holding apparatus that is mounted on the supporting apparatus, the developer material holding apparatus including a shutter configured to open and close a developer material discharging opening formed in the developer material holding apparatus, the supporting apparatus comprising:

a supporting surface that supports the developer material holding apparatus thereon;

a first limiting element that limits movement of the developer material holding apparatus in an insertion direction in which the developer material holding apparatus is inserted into the supporting apparatus;

a shutter movement limiting element that limits movement of the shutter in the insertion direction;

a second limiting element that limits movement of the developer material holding apparatus in a pull-out direction in which the developer material holding apparatus is pulled out of the supporting apparatus and movement of the shutter in the pull-out direction, the pull-out direction being opposite to the insertion direction, the second limiting element being resiliently deformable; and a third limiting element that limits displacement of the second limiting element when the second limiting element resiliently deforms, wherein the second limiting element is disposed such that as the developer material holding apparatus is pulled out in the pull-out direction, a part of the developer material holding apparatus comes into contact with the second limiting element, causing the second limiting element to resiliently deform until the second limiting element abuts the third limiting element.

* * * * *